US005736305A

United States Patent [19]

Nomura

[11] Patent Number: 5,736,305

[45] Date of Patent: Apr. 7, 1998

[54] PROCESSING METHOD FOR SILVER HALIDE PHOTOSENSITIVE MATERIALS AND PROCESSOR FOR THE SAME

[75] Inventor: Hideaki Nomura, Kanagawa, Japan

[73] Assignee: Fuji Photo Film Co., Ltd., Kanagawa, Japan

[21] Appl. No.: 781,350

[22] Filed: Jan. 21, 1997

[30] Foreign Application Priority Data

Jan. 23, 1996 [JP] Japan ..... 8-009038

[51] Int. Cl.[6] ..... G03C 5/26

[52] U.S. Cl. ..... 430/403; 430/500; 430/501

[58] Field of Search ..... 430/403, 500, 430/501; 396/625

[56] References Cited

U.S. PATENT DOCUMENTS

| | | | |
|---|---|---|---|
| 1,197,734 | 9/1916 | Grabert et al. | 396/625 |
| 3,565,626 | 2/1971 | Craig et al. | 430/403 |
| 4,920,041 | 4/1990 | Ohki et al. | 430/467 |
| 5,093,686 | 3/1992 | Shigaki | 355/77 |
| 5,234,802 | 8/1993 | Nakamura et al. | 430/403 |
| 5,491,051 | 2/1996 | DeCory et al. | 430/501 |
| 5,491,530 | 2/1996 | Earle et al. | 396/576 |
| 5,543,882 | 8/1996 | Pagano et al. | 396/595 |
| 5,580,707 | 12/1996 | Kawamoto | 430/501 |

FOREIGN PATENT DOCUMENTS

| | | |
|---|---|---|
| 4294347 | 10/1992 | Japan . |
| 5188562 | 7/1993 | Japan . |
| 5210196 | 8/1993 | Japan . |
| 5273719 | 10/1993 | Japan . |
| 7319141 | 8/1995 | Japan . |

*Primary Examiner*—Hoa Van Le

*Attorney, Agent, or Firm*—Sughrue, Mion, Zinn, Macpeak & Seas, PLLC

[57] ABSTRACT

The present invention provides a method and a processor for processing silver halide photosensitive materials for photographing. The silver halide photosensitive material is constructed of a support on which are formed at least one photosensitive silver halide emulsion layer and a magnetic recording layer which contains magnetic particles. The photosensitive material undergoes color development, desilvering, and washing and/or stabilization within a processing container, with no requirement to be separated from its housing container for photographing. Subsequently, the thus-processed photosensitive material is returned into the housing container. The processing method and the processor feature simple work, high image quality, and an easy-to-operate compact structure.

16 Claims, 5 Drawing Sheets

PROCESSING METHOD FOR SILVER HALIDE PHOTOSENSITIVE MATERIALS AND PROCESSOR FOR THE SAME

BACKGROUND OF THE INVENTION

1. Field of the Invention

The present invention relates to a method and apparatus for processing silver halide photosensitive materials (hereinafter may be referred to as photosensitive materials) for use in photographing, and particularly to a processing method for developing, through use of a simplified compact processor, a sensitive material composed of a support having silver halide emulsion layers and a magnetic recording layer.

2. Description of the Related Art

Generally, a method of processing silver halide photosensitive materials includes the steps of color development, desilvering, washing, and stabilization.

In the currently most popular image recording method called the negative/paper method, after a color film loaded within a camera is imagewisely exposed and then processed, an image on the processed film is printed onto color printing paper (also called color paper) by printing, and then the printed color paper is developed to obtain a color image (also called a print).

With popularization of mini-labs and rapid color processing agents typified by "CN-16L/CP-47L," the above-mentioned processing is so accelerated that processing is completed within the day. However, after making request for development at a photo processing shop, a customer has to wait for at least about 20 minutes before he/she receives prints. In actuality, therefore, the customer leaves the shop and later returns to receive prints. Because of this inconvenience to the customer, further acceleration of processing is a significant problem that must be solved.

Also, in order to reduce cost and manual work, decrease the environmental burden, reduce the size of a processor, and improve the value of prints, such a mini laboratory is in need of a method and apparatus requiring less amounts of processing solutions and providing stable, excellent processing performance.

Further, complaints of customers include insufficient adjustment of finished colors and density of a print, as well as a difference between additional prints and original ones.

These quality-related problems can be solved by recording, on a negative film, information regarding photographing conditions performed by a customer, information regarding previous printing, etc.

As a specific solution, the so-called "advanced photo system" has recently been proposed, wherein a transparent magnetic recording layer is formed on a photosensitive material so as to record data originating from a camera and entered by a customer while photographing, and the thus recorded data is read by a laboratory device to utilize the data for detecting a print type, for improving print quality, and for printing characters having various information on a print.

In this system, an imagewisely exposed film is reloaded from a film cartridge for photographing use into an intermediate film cartridge exclusively used for processing, by the use of a device called a "detacher." Subsequently, a film leader is attached to the film for development at a film processor. After development, the film leader is removed, and then the developed film is loaded again into the original film cartridge by the use of a device called a "reattacher."

Accordingly, in spite of improved print quality, the addition of a "detacher" and a "reattacher" to a conventional system raise another problem in terms of equipment cost, processing space, working time, and manpower.

SUMMARY OF THE INVENTION

In view of the foregoing, it is an object of the present invention to provide a processing method wherein an imagewisely exposed photosensitive material is processed without being removed from its cartridge for photographing and then the developed photosensitive material is returned into the same cartridge, as well as to provide a simplified compact processor for use in the method and capable of providing improved print quality, to thereby eliminate troublesome work such as the use of an intermediate cartridge and the attachment of a film leader as involved in a conventional processing system.

The above-mentioned object has been achieved by the processor and the processing method described below.

According to a first aspect of the present invention, there is provided a processing method for processing a silver halide photosensitive material for photographing, comprising the steps of: introducing a processing solution into a processing container for developing a silver halide photosensitive material for photographing, which has a support and at least one photosensitive silver halide emulsion layer and a magnetic recording layer containing magnetic particles on the support, without separating the photosensitive material from its housing container for photographing, such that the solution is introduced into a gap formed between the photosensitive surface of the photosensitive material and the reverse surface of the photosensitive material or between the photosensitive surface of the photosensitive material and a member; replacing, before a single step of processing is completed, the processing solution in a volume equivalent to or greater than a volume of the space of the gap through use of supplying mechanism for supplying the replacing solution, the gap being substantially fixedly retained, to thereby subject the photosensitive material to color development, desilvering, and washing and/or stabilization; and returning the processed photosensitive material back into the housing container.

Preferably, a drying section is provided between the housing container and the processing container so that the processed photosensitive material is returned into the housing container after or while being dried in the drying section.

Preferably, the photosensitive material has perforations along only one of its side edges, and the processing solution is introduced from an unperforated side across its width.

Preferably, the support of the photosensitive material has a thickness of 50 to 150 μm and is of polyethylene-aromatic-dicarboxylate type polyester having a glass transition temperature of 50° to 200° C., and the support is thermally treated at a temperature of not less than 40° C. and not more than the glass transition temperature for 0.1 to 1500 hours, before an undercoat layer is formed thereon or during the time between formation of the undercoat layer and formation of an emulsion layer.

Preferably, the color developing solution does not substantially contain hydroxylamine.

According to a second aspect of the present invention, there is provided a processor for processing a silver halide photosensitive material for photographing, comprising: conveyor mechanism for conveying into a processing container for development use a silver halide photosensitive material for photography use, which has a support and at least one photosensitive silver halide emulsion layer and a magnetic recording layer containing magnetic particles on the support, a core about which the photosensitive material is wound being rotatably housed in a housing container for photography use, the core rotating to advance a leading end of the photosensitive material through a passageway provided in the housing container whereby the photosensitive material is conveyed through an outlet of the housing container to the processing container for development; and means for introducing a processing solution into a gap formed between the photosensitive surface of the photosensitive material and the reverse surface of the photosensitive material or between the photosensitive surface of the photosensitive material and a member, the gap being substantially fixedly retained with respect to the photosensitive surface of the photosensitive material; the processing container being a single processing container in which at least one photosensitive material undergoes color development, desilvering, and washing and/or stabilization, and the processed photosensitive material being returned into the housing container through rotation of the core and/or by the conveying mechanism; wherein the processor has no means for detaching the photosensitive material from the housing container.

Preferably, a drying section is provided between the housing container and the processing container so that after being processed, the photosensitive material is dried in the drying section while being returned into the housing container.

Preferably, the distance between the photosensitive material passageway outlet of the housing container and the inlet for the photosensitive material of the processing container is 0.5 cm to 10 cm.

DESCRIPTION OF THE PREFERRED EMBODIMENTS

Figure 1:
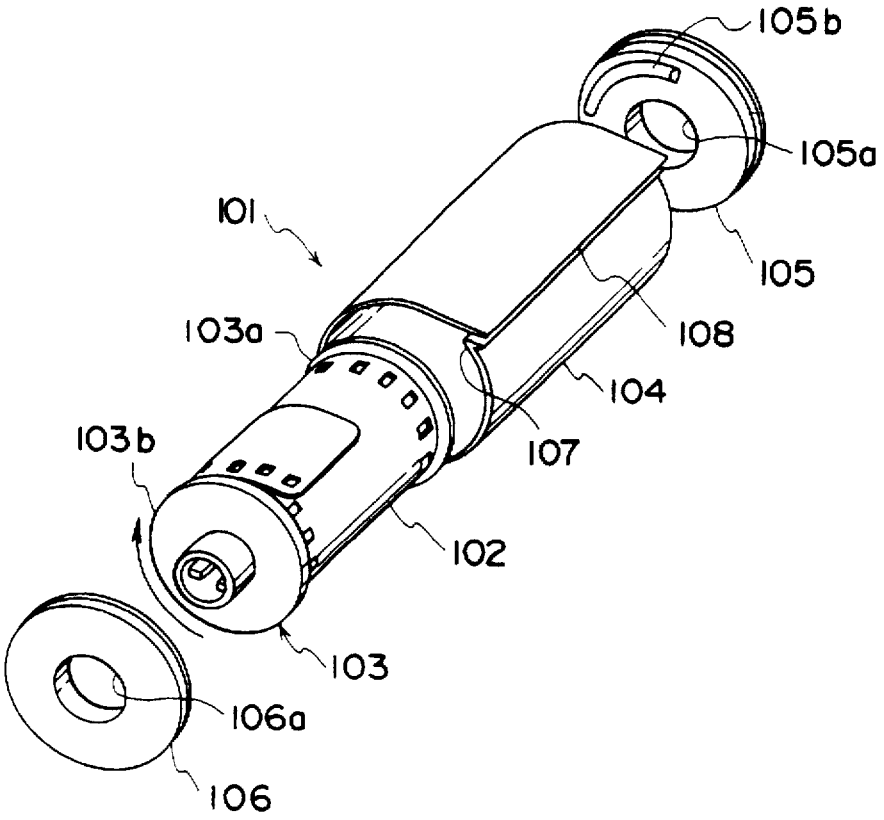
FIG. 1 is an exploded perspective view of a housing container for photographing and being used with an embodiment of the present invention.

The present invention will now be described in detail.

A processor of the present invention does not involve troublesome work such as the reloading of an imagewisely exposed photosensitive material into an intermediate cartridge for processing and the attachment of a leader to the photosensitive material. The processor allows the development of the photosensitive material supplied from a housing container for photographing (hereinafter merely referred to as a cartridge) with no requirement to separate the photosensitive material from the cartridge. The developed photosensitive material is returned into the cartridge. Thus, the processor can be made compact.

In a cartridge used in the present invention, an unexposed photosensitive material is entirely contained within a cartridge in a wound manner. When the photosensitive material is used for photographing, a core (hereinafter may be referred to as spool) is rotated to advance the photosensitive material from the cartridge. A light-shielding ribbon having velvet piles is provided at a photosensitive material passageway slit of the cartridge so as to prevent ambient light from entering the cartridge interior. As disclosed in U.S. Pat. Nos. 4,848,693 and 5,317,355 and Japanese Patent Application Laid-Open (JP-A) No. 3-37645, an openable door may be used to reliably light-shield the passageway slit, but the light-shielding method is not limited thereto.

A cartridge used in the present invention may be structured as disclosed in U.S. Pat. Nos. 4,834,306, 5,226,613, 5,296,886, and 5,347,334, and Japanese Patent Application Laid-Open (JP-A) No. 5-210202. Also, there may be employed cartridges used in systems disclosed in Japanese Patent Applications Laid-Open (JP-A) Nos. 7-199441 and 7-244365.

A main material for a cartridge used in the present invention may be metal or synthetic plastic.

Preferred plastic materials include polystyrene, polyethylene, polypropylene, and polyphenyl ether. A cartridge used in the present invention may contain any of a variety of antistatic agents, preferably carbon black, metal oxide particles, nonionic, anionic, cationic, or betaine-type surfactants or polymers. Cartridges having antistatic property are described in Japanese Patent Application Laid-Open (JP-A) Nos. 1-312537 and 1-312538. Particularly, electrical resistance is preferably not more than $10^{12}$ ohms at 25° C. and 25% RH. An ordinary plastic cartridge is made of plastic kneaded with carbon black and pigment for imparting a light-shielding property. The cartridge size may be size 135 of current use, or to conform to a reduction of the size of cameras, a cartridge diameter of 25 mm (size 135) of current use may be reduced to 22 mm or less. The volume of a cartridge case is not more than 30 $cm^3$, preferably not more than 25 $cm^3$. The weight of plastic used for a cartridge or a cartridge case is preferably 5 to 15 g.

A processing container used in the present invention for development is designed to process a photosensitive material through use of processing solutions for color development, desilvering, and washing and/or stabilization. That is, the processing container is used to circulate and replace a processing solution.

In order to process a photosensitive material without separating it from a cartridge through use of a conventional hanger-type automatic processor, a continuous type (cine type) automatic processor, or the like, it is necessary to remodel (elongate, for example) a processing tank or a processing rack and to employ complicated mechanisms. Thus, these processors are not preferred from the viewpoint of compactness and simplicity.

Accordingly, in order to reduce the consumption of processing solutions for processing a photosensitive material and make a processor compact, processing systems as disclosed in Japanese Patent Application Laid-Open (JP-A) Nos. 4-230475, 5-273719, and 6-110175 are preferred wherein at least two photosensitive materials are arranged in layers such that a gap is substantially fixedly retained between the photosensitive surface of the photosensitive material and the reverse surface of the photosensitive material, or between the photosensitive surfaces opposing to each other and such that a processing solution is supplied into the gap. The gap can be formed by means of projections formed with predetermined intervals on a photosensitive material at a non-image area, preferably along both side edges of the photosensitive material. Alternatively, the gap may be formed through use of another member. Examples of such a member include a non-photosensitive film having projections, an embossed film, and a member for supporting both side edge portions of a photosensitive material to form a gap. A method of forming the gap is not limited thereto, so long as the following gap is provided. The gap may have any size for stably supplying a processing solution thereinto, normally 0.005 to 2 mm, preferably 0.01 to 1 mm, more preferably 0.05 to 0.5 mm.

The expression "a gap is substantially fixedly retained" means that the gap is retained by a mechanism which fixedly forms the gap formed between the photosensitive surface of the photosensitive material and the reverse surface of the photosensitive material, or between the photosensitive surface of the photosensitive material and the surface of another member. This technique is different from the methods employed in processing using "Darkless" (trade name) processing tool manufactured by Fuji Photo Film Co., Ltd. (processing in which a film is wound in a convoluted manner), processing using a processor as disclosed in Japanese Utility Model Application Laid-Open (JP-U) No. 50-105457, and processing wherein a viscous developer for photosensitive materials of instant photography is applied to the photosensitive surface. The term "substantially" implies the acceptance of some variations in the gap while a processing solution is supplied, for example, variations in the gap caused by swelling of a photosensitive material. Also, some variations in the gap are acceptable at a portion located away from a mechanism for fixedly retaining the gap, such as projections as compared with portions in the vicinity of the projections. It suffices to provide a gap where a processing solution can be introduced to the gap and replaced to process a photosensitive material.

In the preferred modes described above, a processing solution is preferably replaced in a volume at least equivalent to a volume of the space of the gap before a single step of processing is completed. The volume of the space of the gap is the total volume of the space of the gap which is formed between the photosensitive surface of the photosensitive material and the reverse surface of the photosensitive material, or between the photosensitive surface of a photosensitive material and the surface of another member, before a processing solution is supplied into the gap, i.e. before the photosensitive material is swollen with the solution. In processing of photosensitive materials for monochromatic photographs, a single step of processing is each of a developing step, a fixing step, a stopping step, a washing step, and the like; in processing of photosensitive materials for color photographs, each of a color developing step, a fixing step, a bleaching step, a bleaching/fixing step, a reversal developing step, a stabilizing step, a washing step, and the like. It is not necessary to replace a processing solution in an equivalent or larger volume in all these steps. However, preferably, a processing solution is replaced in an equivalent or larger volume in at least one processing step including the developing step.

A processing solution is replaced preferably in an equivalent volume or more, more preferably in one equivalent volume to 100 equivalent volumes, most preferably one equivalent volume to 10 equivalent volumes with respect to the total volume of the space of the gap. When a processing solution is replaced by changing the direction of flow of the solution, during a single step of processing, the direction of flow is preferably changed twice or more, more preferably three to one hundred times, particularly preferably four to ten times. If the direction of flow is changed less frequently, it will become difficult to obtain photographic images without unevenness constantly. On the contrary, if the direction of flow is changed too frequently, the consumption of a processing solution will increase, resulting in an increased environmental burden.

The direction of flow of replacing a processing solution may be fixed within the same step of processing or may be changed (for example, reversed) with time. Also, the flow of a processing solution may be halted before the flow is reversed. When the direction of flow of replacing a processing solution is changed with time or the flow of a processing solution is halted before the flow is reversed, these modes of replacement are preferred in view of suppressing unevenness of processed film due to the processing that often occurs in the case where a replacing processing solution flows in a fixed direction. However, these modes have been found insufficient for obtaining desired photographic quality when a rapid processing is needed. A conceivable method for reversing the flow of a processing solution is to reciprocate a piston within a cylinder by a motor or to reverse the direction of rotation of a pump to thereby supply a processing solution under pressure in a reversed direction of flow. These methods, however, involve problems of a complicated structure of the entire processor and of a difficulty in finely adjusting a pump output. These problems have been solved by employing an implementation wherein perforations are formed in a photosensitive material only along its one side edge and wherein a replacing processing solution is introduced into a gap from the unperforated side of the photosensitive material across the width of the photosensitive material. That is, both acceleration of processing and simplification of apparatus can be attained by employing this implementation.

By forcibly supplying a processing solution into a narrow gap by supplying means, as opposed to by free fall or the like, as described above, photographic images having good quality have been unexpectedly obtained even when a small amount of a processing solution is used. Processing can be performed very efficiently by placing a photosensitive material in a flowing processing solution. This processing method has become feasible because of the attainment of advanced stirring of solution which cannot be attained by a conventional tank development method.

According to a preferred embodiment of the present invention, at steps of processing, a rather small amount of a processing solution is supplied into a processing container, and the processing solution is moved, without substantially moving a photosensitive material contained in the processing container, thereby efficiently processing the photosensitive material. According to the present invention, a photosensitive material can be processed through use of a processing solution in at least twice as large a volume as a volume of the space of a gap retained between the photosensitive surface of the photosensitive material and the reverse surface of the photosensitive material, or between the photosensitive surface of the photosensitive material and the surface of another member. Here, the expression "without substantially moving" means that moving the photosensitive material within the processing container, for example, by manually shaking the container, is avoided.

A processor according to the preferred embodiment of the present invention can be preferably used because its compact structure allows lower consumption of the processing solution and lower evironmental load. Also, there is no need to consider aging (deterioration) of a processing solution during processing, and thus a processing agent becomes easy to be formulated.

There is no particular restriction on a method for replacing a processing solution. For example, when an elongated photosensitive material is convoluted, a processing solution is supplied preferably in a direction substantially perpendicular to the longitudinal direction of the photosensitive material for good efficiency of replacement. Here, the expression "substantially perpendicular" preferably means 90°±30°. For photosensitive materials in a sheet form, a processing solution is moved preferably along a shorter pass of a gap for better achievement of processing (suppression of unevenness of the processed photosensitive material caused by processing and the like).

In a drying step, warm air may be supplied into a processing container used for the above-mentioned processing so as to dry a photosensitive material in the container. However, most preferably, in order to suppress unevenness of a processed photosensitive material due to drying and for quick drying, a drying section is provided between the processing container and a cartridge.

An arrangement for carrying out all the steps from a color development step through a drying step within the same processing container has been found to raise a new problem of a stain on a photosensitive material being caused by a trace of deposit which has deposited in the processing container and a piping system as a consequence of continuous processing, if conducted over a long period of time. However, this problem does not arise when the drying section is provided between the processing container and the cartridge as described above. Further, this arrangement has been found to provide significantly good effects.

Next, a specific structure will be described.

FIG. 1 shows an exploded view of a cartridge used in the present invention. A cartridge 101 is composed of a spool 103 about which a photosensitive material 102 is wound in a roll form, a cartridge shell 104 for accommodating the spool 103, and disks 105 and 106 for rotatably supporting the spool 103 and for closing the cartridge shell 104 from opposite sides thereof in a light-shielding manner.

The spool 103 includes a flange **103*a* formed thin to be flexible and a flange 103*b* formed thick to be inflexible and is integrally formed of plastic. The photosensitive material 102 is fixed at its trailing end portion onto the spool 103 between the flanges 103*a* and 103*b* and is wound about the spool 103 and along the inner faces of the flanges 103*a* and 103*b* in a roll form and such that the entire photosensitive material 102 up to its leading end is wound into the cartridge shell 104. The cartridge shell 104 has a photosensitive material passageway slit 108 to which a light-shielding door 107** (not shown) is attached for opening and closing movements.

A bearing **105*a* is formed at the central portion of the disk 105 for rotatably supporting an end portion of the spool 103. A ridge 105*b* is formed on the inner face of the disk 105 for pressing a part of the flange 103*a*. A bearing 106*a* is formed at the central portion of the disk 106 for rotatably supporting another end portion of the spool 103. A projection (not shown) is formed on the inner face of the disk 106 near the bearing 106*a* for reducing friction against the flange 103*b***.

The ridge **105*b* presses the flange 103*a* to cause it to deform, thereby press-holding side edges of the photosensitive material 102 against the flanges 103*a* and 103*b*. Accordingly, as the spool 03 is rotated in a direction of the arrow of FIG. 1, the friction of the flanges 103*a* and 103*b* against side edges of the photosensitive material 102 causes a leading end portion of the photosensitive material 102 to advance from the cartridge shell 104 through the photosensitive material passageway slit 108**.

Figure 2:
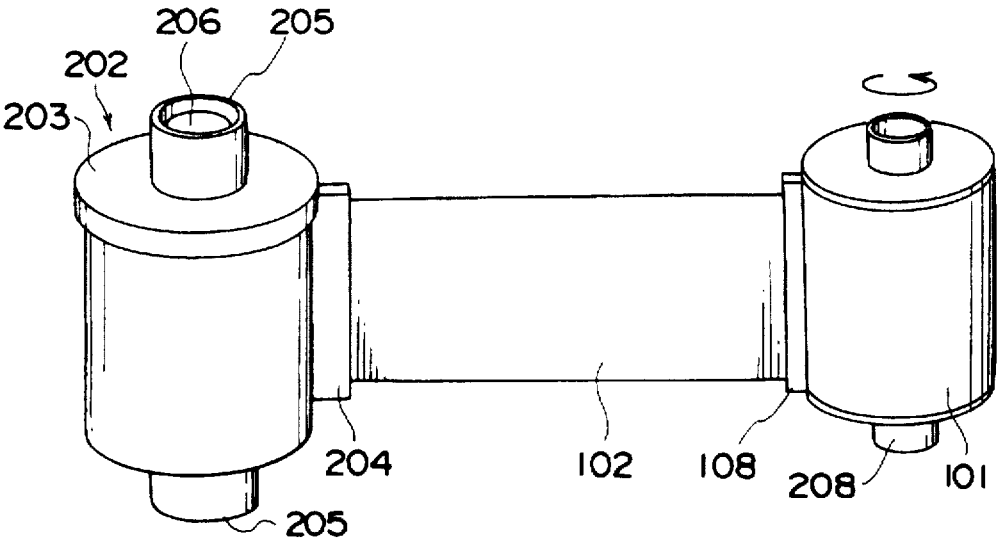
FIG. 2 is a schematic perspective view illustrating an operation of conveying a photosensitive material into a processing container.
Figure 3:
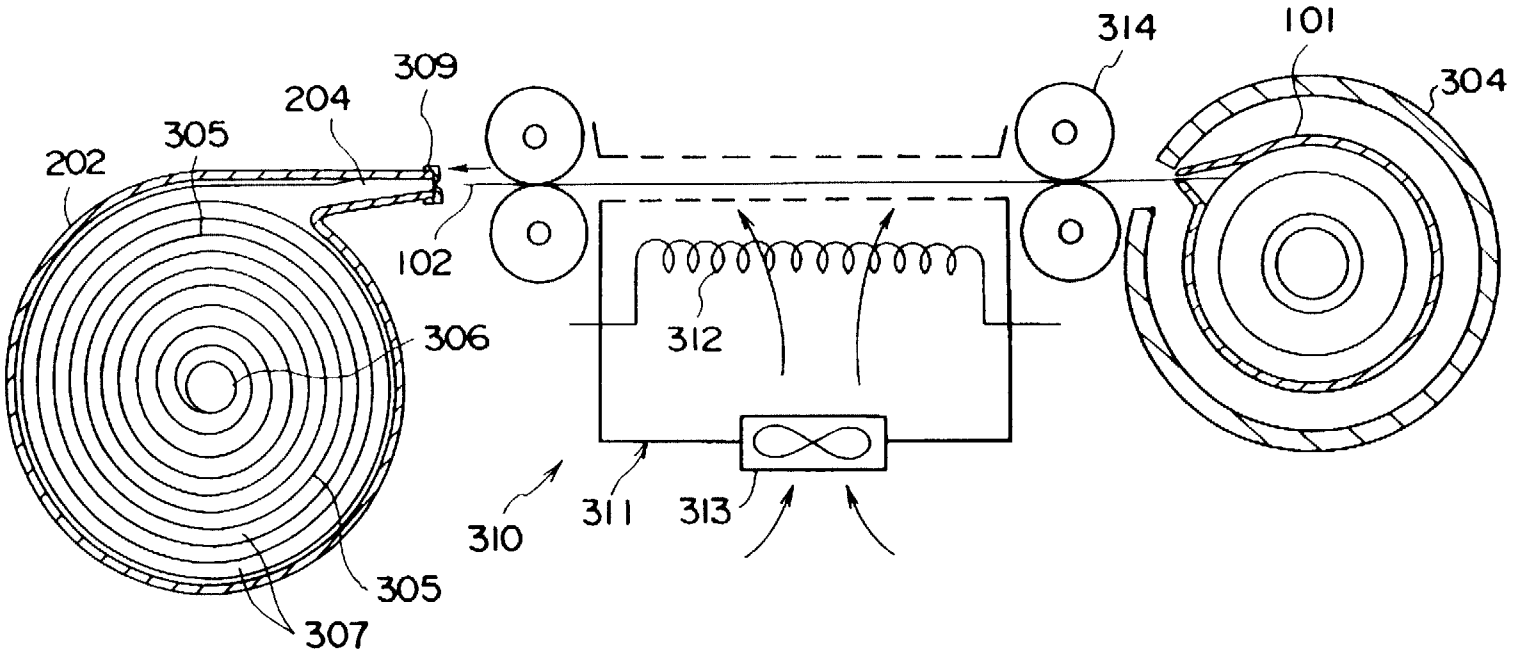
FIG. 3 is a schematic cross-sectional view showing the arrangement of the housing container, the processing container, and a drying section.

FIGS. 2 and 3 illustrate processing in a processing container according to the preferred embodiment of the present invention.

As shown in FIG. 2, the imagewisely exposed photosensitive material 102 is transferred from the cartridge 101 to a processing container 202 as described below.

First, a core 208 is rotated in a direction of the arrow of FIG. 2 in a dark place such as a darkroom or a dark box. As a result, the photosensitive material 102 is continuously advanced from the cartridge 101 and then is introduced into the processing container 202 through a film passageway slit 204 by guide-transport rollers (not shown) or the like.

Alternatively, an end portion of a leader film (not shown) of the processing container 202 and the leading end of the photosensitive material 102 may be jointed together by means of adhesive tape or the like. Then, a core 206 is rotated to draw out the photosensitive material 102 from the cartridge 101 through traction of the leader film to thereby lead the photosensitive material 102 into the processing container 202.

Preferably, a film passage between the photosensitive material passageway slit 108 of the cartridge 101 and the film passageway slit 204 of the processing container 202 is covered with a light-shielding case (not shown) to thereby enable a user to conduct the above-mentioned work outside the dark place. A processing solution is introduced into the interior of the processing container 202 through a processing solution inlet 205.

The photosensitive material 102 introduced into the processing container 202 is taken up, for example, along a separator 305 to be housed within the processing container 202 as shown in FIG. 3.

Preferably, in order to maintain a gap 307 between the photosensitive material 102 and the separator 305, projections (not shown) or the like are provided at predetermined intervals on the photosensitive material 102, the separator 305, or the leader film (not shown).

In this case, the projections are formed preferably by deforming the separator 305 or the leader film because of readiness and low cost of the forming work. Projections on the photosensitive material 102 are formed preferably after an emulsion layer is coated onto the support of the photosensitive material 102. Alternatively, the projections may be formed on the photosensitive material 102 in the time between completion of photographing and start of processing.

So long as a processing solution is stably supplied through the gap, the gap may assume any dimension. The gap is normally 0.005 to 2 mm, preferably 0.01 to 1 mm, more preferably 0.05 to 0.5 mm. A narrow gap is preferred in view of making the processing container 202 compact. However, if the gap is too narrow, it will be difficult to obtain a good image, because of unevenness of a processed photosensitive material caused by processing.

Next, the film passageway slit 204 of the processing container 202 is solution-shielded. This shielding can be attained, for example, by attaching a cap 309 to the film passageway slit 204 as shown in FIG. 3.

Means for solution-shielding the film passageway 204 is not limited to the cap 309. For example, seal tape may be stuck onto the tip of the film passageway 204, or the film passageway 204 may be press-closed.

A processing solution is supplied into the gap 307 between the photosensitive material 102 and the separator 305 by a pump under pressure, under reduced pressure, or in combination thereof. This supply pressure depends on viscosity of a processing solution within the gap 307 formed between the photosensitive surface of the photosensitive and the surface of the separate 305, and is normally 0.2 to 20 $kg/cm^2$, preferably 1 to 6 $kg/cm^2$.

The volume of the space of the gap 307 depends on the width and length of the photosensitive material 102. For example, for a 40-exposure photosensitive material having a width of 24 mm, the volume is 5 to 30 ml, preferably 7 to 15 ml to thereby achieve good development with a compact processing container.

The volume of consumption of a processing solution at a single step of processing is preferably 5 to 100 ml, more preferably 10 to 50 ml.

When the above-described method is implemented by an automated apparatus, a processing container is preferably vibrated to thereby avoid forming a main fluid stream of a processing solution.

The processor and the processing method according to the preferred embodiment of the present invention allow a user to start processing with a fresh processing solution and to sufficiently consume the solution. This has been found not only to reduce the consumption of a processing solution through efficient use thereof but also to stabilize processing. Furthermore, it has also been found that the invention unexpectedly provides an excellent effect of increasing the sensitivity of a photosensitive material and making image grains finer.

The photosensitive material 102 advanced from the cartridge 10, which is contained within a cartridge magazine 304, is supplied into the processing container 202 by pairs of transporting rollers 314. Upon completion of processing within the processing container 202, the photosensitive material 102 on the way back into the cartridge 101 is dried at a drying section 310. The drying section 310 includes a blower 313 and a heating apparatus 311 having a heater 312.

Figure 4:
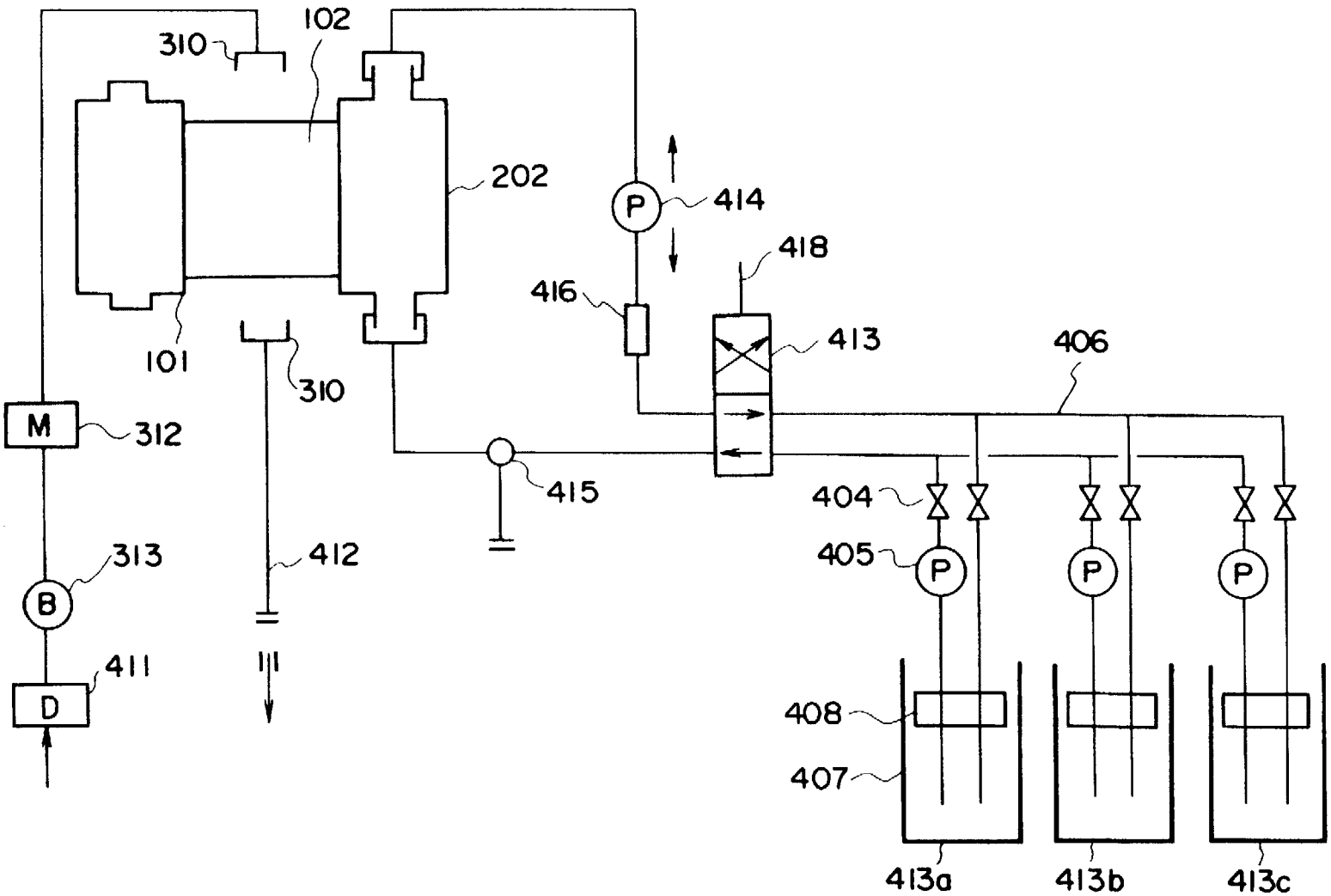
FIG. 4 is a schematic block diagram of an automatic processor according to an embodiment of the present invention.

FIG. 4 shows a schematic block diagram of an automatic processor according to an embodiment of the present invention. As shown in FIG. 4, an elongated color negative film 102 as an example of a photosensitive material is contained in a cartridge 101, which in turn is housed within a cartridge magazine (not shown) located upstream of a processing container 202. The film 102 is automatically supplied into the processing container 202 to be processed therein. After being processed within the processing container 202, the film 102 is dried at a drying section 310.

For example, three kinds of processing solutions 413*a* to 413*c* are prepared in respective processing solution tanks 407. Pumps 405 sequentially feed corresponding processing solutions to the processing container 202 via piping 406 to thereby process the photosensitive material 102 within the processing container 202.

A processing solution is regulated to a predetermined temperature by a temperature regulating apparatus 416 provided in piping while being circulated.

A method of regulating the temperature of a processing solution is not limited to the above-described temperature regulation in piping. For example, processing solutions 413*a* to 413*c* may be directly temperature-regulated, or the entire processor may be temperature-regulated.

In operation, first, a first processing solution is supplied to a passage including a pump 405, a selector valve 413, a pump 414, the processing container 202, and a drain cock 415. Subsequently, the selector valve 413 is operated so as to form a looped passage. Then, the pump 414 is run to circulate the processing solution through the lopped passage, thereby processing the photosensitive material 102 as required.

By periodically reversing the rotational direction of the pump 414, the processing solution sufficiently reaches the peripheries of projections (not shown) formed to give a gap and of perforations in the photosensitive material 102 to thereby restrain uneven processed image caused during processing from occurring. This method is suited for standard processing whose processing time is relatively long.

For rapid processing, in order to obtain required photographic quality through enhanced stirring, it is preferable that a processing solution be continuously supplied in a fixed direction. In this case, by supplying the processing solution from the unperforated side of the photosensitive material 102 across the width of the photosensitive material 102, uneven processed image caused by bubbles or the like can be prevented.

Upon completion of processing with the first processing solution, the drain cock 415 is opened, and at the same time, an air vent 418 of the selector valve 413 is opened. As a result, air naturally flows into the passage, causing the processing solution to be drained from the processing container 202 to the exterior of the looped passage. Next, each of the second and third processing solutions is supplied into the processing container 202 in the same manner, thereby processing the photosensitive material 102.

Upon completion of processing with all the processing solutions, the photosensitive material 102 is taken up into the cartridge 101 while being dried at the drying section 310 provided between the processing container 202 and the cartridge 101.

In this mode of drying, air dehumidified by a dehumidifier 411 is supplied to the drying section 310 by a blower 313 via a heater 312, thereby drying the photosensitive material 102 being taken up into the cartridge 101.

No perforations are formed in the illustrated photosensitive material 102, but perforations may be formed. In other words, the present invention accepts either of the perforated and unperforated photosensitive materials 102.

For both convenience of supply and prevention of unevenness of processed images, perforations are preferably formed in a photosensitive material along one side edge thereof.

Figure 5:
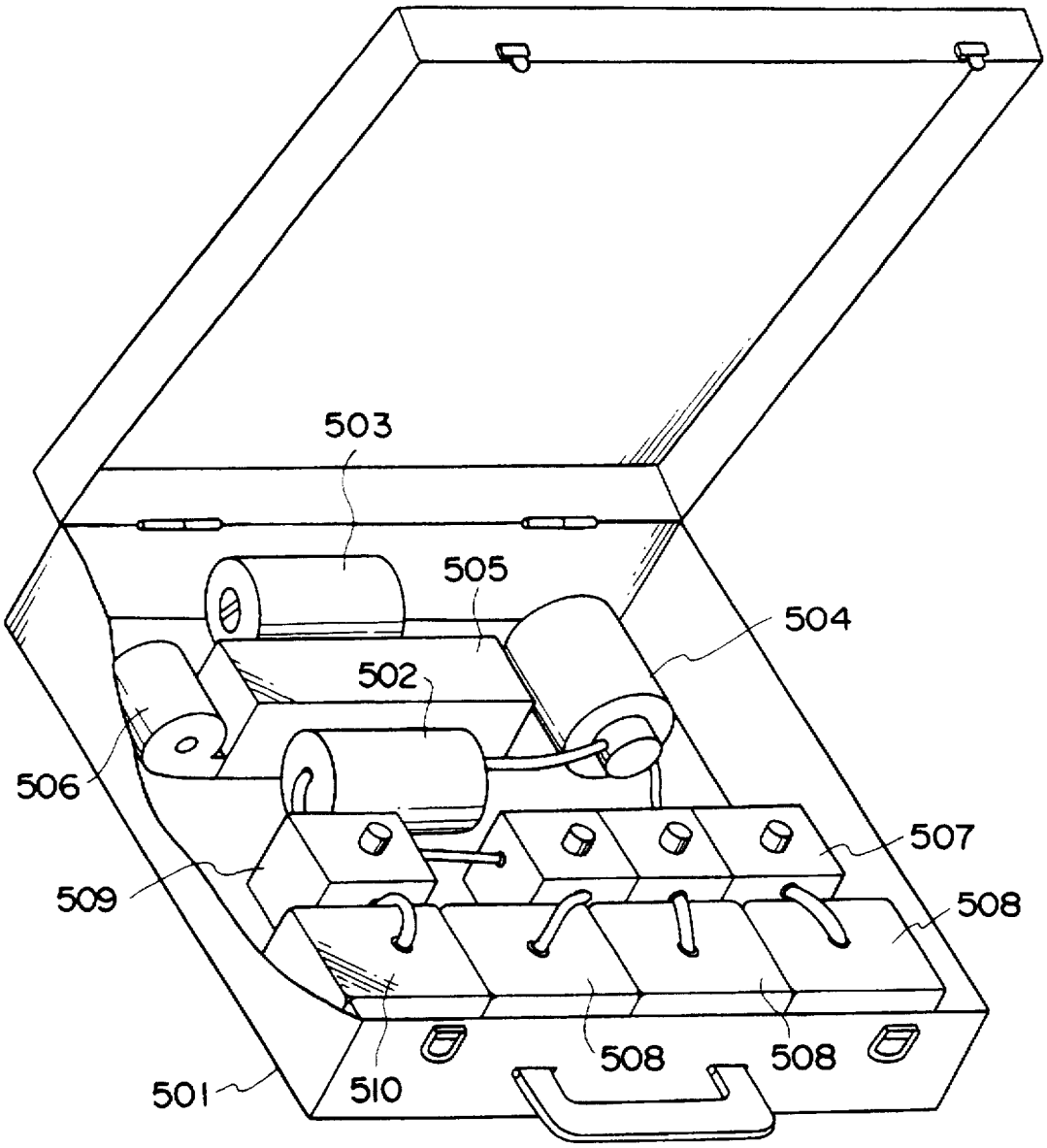
FIG. 5 is a perspective view schematically showing an automatic processor according to another embodiment of the present invention.
Figure 6:
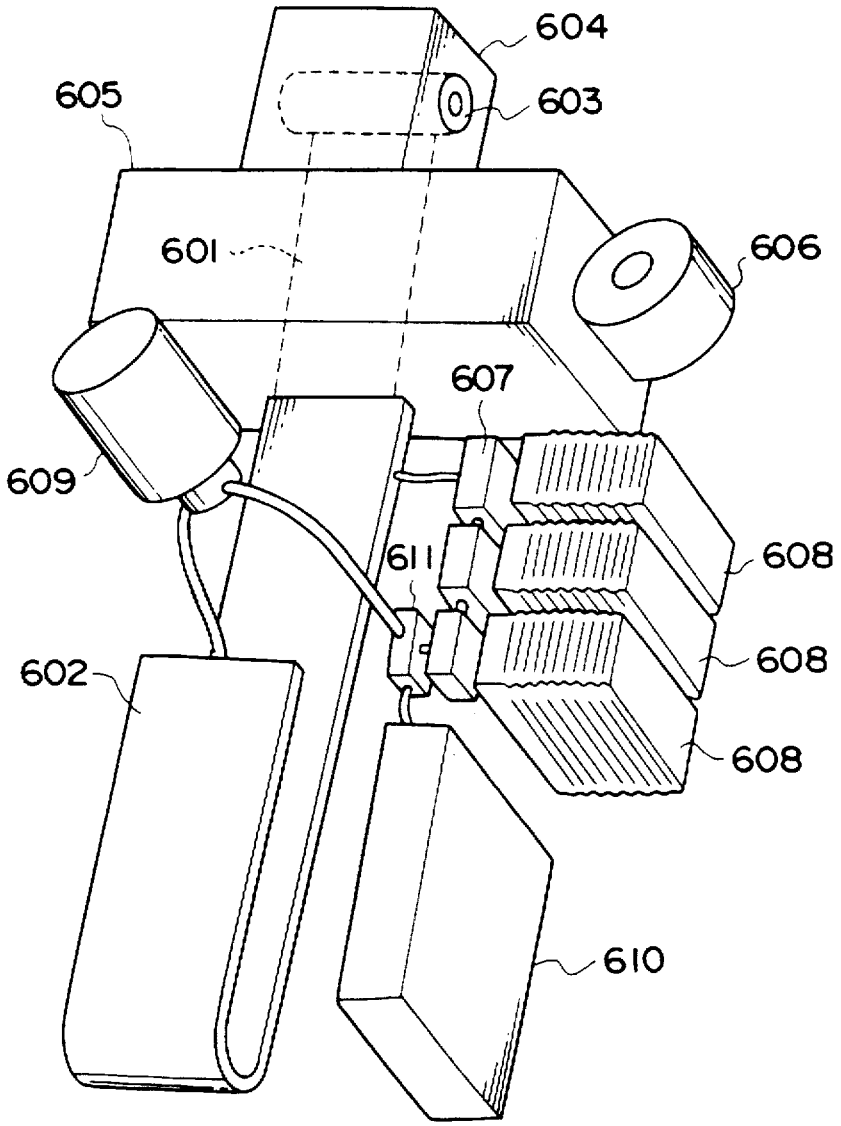
FIG. 6 is a perspective view schematically showing an automatic processor according to still another embodiment of the present invention.

FIGS. 5 and 6 show an automatic processor having the construction shown in FIG. 4. In the automatic processor of FIG. 5, a photosensitive material (not shown) wound in a roll form is processed within a processing container 502. The processor is quite compact as a whole.

In FIG. 5, numeral 501 denotes a light-shielding case; 503, a cartridge which contains an imagewisely exposed film; 504, a processing solution pump; 502, a processing container; 505, a drying section; 506, a blower; 507, valves; 509, a drain cock; 508, processing solution tanks; and 510, a drain tank.

In the automatic processor of FIG. 6, a photosensitive material 601 arranged in horizontal layers is processed within a processing container 602. The processor provides a reliable supply of a photosensitive material 601 into a processing container 602.

In FIG. 6, numeral 603 denotes a cartridge which contains an imagewisely exposed photosensitive material; 602, a processing container; 604, a cartridge magazine; 605, a drying section; 606, a blower; 608, processing solution tanks; 607, valves; 609, a processing solution pump; 610, a drain tank; and 611, a drain cock.

The distance between the photosensitive material passageway slit of a housing container and the photosensitive material passageway slit of a processing container is preferably 0.5 cm to 10 cm, preferably 1 cm to 8 cm, particularly preferably 1.5 cm to 6 cm. If the distance is too short, the equipment design load will become too large to install closing means for the photosensitive material passageway slit of the processing container and drying means. If the distance is too long, optical information and magnetic information stored on a photosensitive material will fail to be sufficiently utilized due to an increase in the undeveloped portion of the photosensitive material.

Next will be described a silver halide photosensitive material (hereinafter merely referred to as photosensitive material) used in the present invention.

First, a magnetic recording layer used in the present invention will be described.

The magnetic recording layer used in the present invention is formed on a support by the application of an aqueous coating solution or organic-solvent-based coating solution with magnetic particles being dispersed therein.

In the photosensitive material of the present invention, at least one magnetic recording layer may be formed on the support. There is no restriction on the number of layers applied and the order of layers applied. In a typical photosensitive material, a silver halide layer is formed on one side of the support, and a magnetic recording layer is formed on the other side of the support.

Magnetic particles usable in the present invention include ferromagnetic iron oxides such as gamma-$Fe_2O_3$, Co-deposited gamma-$Fe_2O_3$, Co-deposited magnetite, ferromagnetic chromium dioxide, ferromagnetic metals, ferromagnetic alloys, hexagonal-system Ba ferrite, Sr ferrite, Pb ferrite, and Ca ferrite. Magnetic particles used in the present invention are preferably Co-deposited ferromagnetic iron oxides such as Co-deposited gamma-$Fe_2O_3$. Magnetic particles may be in any shape, for example, acicular, rice grain, spherical, cubic, and tabular. The specific surface area of magnetic particles is preferably not less than 30 $m^2/g$ of $S_{BET}$. The saturation magnetization ($\sigma s$) of a ferromagnetic body is preferably $4.0\times10^4$ to $2.5\times10^5$ A/m. Ferromagnetic particles may be surface-treated with silica and/or alumina, or with organic substances. Also, magnetic particles may be surface-treated with a silane coupling agent or a titanium coupling agent as described in Japanese Patent Application Laid-Open (JP-A) No. 6-161032. Alternatively, magnetic particles coated with an inorganic or organic substance as described in Japanese Patent Application Laid-Open (JP-A) Nos. 4-259911 and 5-81652.

Binders used with magnetic particles include a thermoplastic resin as described in Japanese Patent Application Laid-Open (JP-A) 4-219569, thermosetting resins, radiation-setting resins, reactive resins, acid-degradable, alkali-degradpoly, or biodegradable polymers, natural polymers (cellulose derivatives, sugar derivatives, etc.), and their mixtures. These resins have −40° C. to 300° C. of Tg and a weight average molecular weight of 2,000 to 1,000,000. Examples of these resins include vinyl copolymers; cellulose derivatives, such as cellulose diacetate, cellulose triacetate, cellulose acetate propionate, cellulose acetate butylate, cellulose tripropionate; acrylic resins; and polyvinyl acetal resins. Gelatin is also preferred. Cellulose di(tri) acetate is particularly preferred. Binders can be cured through addition of epoxy type, aziridine type, or isocyanate type cross linking agents. isocyanate type cross linking agents are described, for example, in Japanese Patent Application Laid-Open (JP-A) No. 6-59357.

The thickness of the magnetic recording layer is 0.1 μm to 10 μm, preferably 0.2 μm to 5 μm, and more preferably 0.3 μm to 3 μm. The weight ratio between magnetic particles and a binder is preferably 0.5:100 to 60:100, and more preferably 1:100 to 30:100. The coating amount of magnetic particles is 0.005 to 3 $g/m^2$, preferably 0.01 to 2 $g/m^2$, and more preferably 0.02 to 0.5 $g/m^2$. The transmission yellow density of the magnetic recording layer is preferably 0.01 to 0.50, more preferably 0.03 to 0.20, and particularly preferably 0.04 to 0.15. The magnetic recording layer may be formed on the back side of a photographic support by coating or printing over the entire surface thereof or in stripes.

Various functions may be given to the magnetic recording layer. Examples of such functions are for improved lubrication, curl adjustment, antistatic properties, adhesion preventing, and head polishing. Alternatively, another functional layer having such functions may be added. At least one kind of particles are preferably abrasives of nonspherical inorganic particles having Mohs' hardness of not less than 5. Nonspherical inorganic particles preferably comprise powder of oxide such as aluminum oxide, chromium oxide, silicon dioxide, or titanium dioxide, powder of carbide such as silicon carbide or titanium carbide, or powder of diamond. These abrasives may be surface-treated with a silane coupling agent or a titanium coupling agent. These particles may be added to the magnetic recording layer, or the magnetic recording layer may be overcoated with these particles (for example, a protective layer or a lubricant layer). A photosensitive material having a magnetic recording layer is described in U.S. Pat. Nos. 5,336,589, 5,250,404, 5,229,259, and 5,215,874, and EP Patent No. 466,130.

Next will be described a preferred polyester support. For details, including photosensitive materials, processing, cartridges, and embodiments, refer to Technical Bulletin No. 94-6023 (Hatsumei Kyokai, Mar. 15, 1994).

An appropriate support usable in the present invention is described, for example, in Research Disclosure (hereinafter referred to as RD) No. 17643, page 28; RD No. 18716, right column on page 647 to left column on page 648; and RD No. 307105, page 879. A particularly preferred polyester support contains diol and aromatic dicarboxylic acid as essential components. Examples of aromatic dicarboxylic acid include 2,6-, 1,5-, 1,4-, and 2,7-naphthalene dicarboxylic acid, terephthalic acid, isophthalic acid, and phthalic acid. Examples of diol include diethylene glycol, triethylene glycol, cyclohexanedimethanol, bisphenol A, and bisphenol B. Examples of their polymers include polyethylene terephthalate, polyethylene naphthalate, and polycyclohexanedemethanol phthalate. The polyester support is particularly preferably made of polyester which contains 50 mol % to 100 mol % of 2,6-naphthalene dicarboxylic acid, and most preferably of polyethylene 2,6-naphthalate. The average molecular weight ranges from about 5,000 to 200,000. Polyester of the present invention has Tg of not less than 50° C., preferably not less than 90° C.

In order to suppress a tendency to curl, the polyester support is heat-treated at a temperature of not less than 40° C. to lower than Tg, preferably not less than Tg minus 20°

C. to lower than Tg. The polyester support may be heat treated at a fixed temperature or while being cooled, within this temperature range. The heat-treating time is 0.1–1500 hours, preferably 0.5–200 hours. The support may be heat-treated either in a rolled form or while being transferred in a web form. The surface of the support may be roughened, for example, through coating of conductive inorganic particles such as $SnO_2$ and $Sb_2O_5$ to improve the surface properties thereof. It is desirable to knurl the edges of the support to slightly raise the edges above the rest to thereby prevent a transfer of the shape of edges of a core portion. The heat treatment may be performed after any step of formation of the support, surface treatment, coating of a backing layer (coating with an antistatic agent, a lubricant, etc.), and undercoating, preferably after coating with an antistatic agent.

An ultraviolet light absorbing agent may be added to this polyester through kneading. Also, in order to prevent light piping, a dye or pigment marketed for use with polyester may be added. Examples of such a dye or pigment include Diaresin from Mitsubishi Chemical Industries, Ltd. and Kayaset from Nippon Kayaku Co., Ltd.

In the present invention, the support is preferably surface-treated for bonding with a photosensitive material layer. Preferred methods of this surface treatment are ultraviolet radiation treatment, flame treatment, corona discharge treatment, and glow treatment.

Undercoating may be in a single layer or more than one layer. Examples of a binder for use with an undercoat layer include copolymers whose starting materials are monomers selected from among vinyl chloride, vinylidene chloride, butadiene, methacrylic acid, acrylic acid, itaconic acid, maleic anhydride, etc.; polyethyleneimine; epoxy resin; grafted gelatin; nitrocellulose; and gelatin. Compounds for swelling the support include resorcin and p-chlorophenol. A known hardening agent for gelatin can be used with the undercoat layer. $SiO_2$, $TiO_2$, inorganic particles, or polymethyl methacrylate copolymer particles (0.01 to 10 μm) may be contained as a matte agent.

In the present invention, use of an antistatic agent is preferred. Antistatic agents usable in the present invention include polymers containing carboxylic acid, carboxylic acid salts, or sulfonic acid salts, cationic polymers, and ionic surfactants.

A photosensitive material of the present invention preferably has the lubricative property. Preferably, a lubricant-containing layer is formed on both the photosensitive layer side and the back side. The lubricative property is preferably a coefficient of dynamic friction of not more than 0.25 to not less than 0.01.

Lubricants usable in the present invention include polyorganosiloxane, higher aliphatic acid amides, higher aliphatic acid metal salts, and esters of a higher fatty acid and a higher alcohol. Examples of polyorganosiloxane include polydimethylsiloxane, polydiethylsiloxane, polystyrylmethylsiloxane, and polymethylphenylsiloxane. A lubricant is preferably added to an outermost layer of the emulsion layer side and a backing layer. Particularly, polydimethylsiloxane and esters having a long-chain alkyl group are preferred.

A photosensitive material of the present invention preferably has a matting agent. The matting agent may be contained on either the emulsion side or the back side, but is preferably added to an outermost layer of the emulsion side. The matting agent may be either soluble or insoluble in a processing solution. Preferably, both a soluble agent and an insoluble agent are used together. For example, polymethyl methacrylate, poly(methyl methacrylate/methacrylic acid: 9/1 or 5/5 (molar ratio)), and polystyrene particles are preferred.

A photosensitive material of the present invention may comprise a support and at least one photosensitive layer provided thereon. A typical silver halide photosensitive material comprises a support which carries at least one unit photosensitive layer comprising a plurality of silver halide emulsion layers having the substantially same color sensitivity and different photographic sensitivities. The photosensitive layer is a unit photosensitive layer which is color photosensitive to either blue light, green light, or red light. In a multi-layer silver halide color photosensitive material, unit photosensitive layers are generally arranged, from the support side, in the order of a red-sensitive layer, a green-sensitive layer, and a blue-sensitive layer. However, this order of layer arrangement may be reversed, or may be such that among photosensitive layers having the same color sensitivity, an intermediate photosensitive layer has a photographic sensitivity different from that of neighboring photosensitive layers, as needed. A non-photosensitive layer may be placed between the above-described sliver halide photosensitive layers and at the top and bottom of the layered structure. These layers may contain a coupler, a DIR compound, and a color mixing inhibitor, which will be described later. As described in German Patent No. 1,121,470 or British Patent No. 923,045, the silver halide emulsion layers, which constitute each unit photosensitive layer, comprise one high-sensitivity emulsion layer and one low-sensitivity emulsion layer preferably arranged such that the lower-sensitivity layer is located closer to the support. Also, as described in Japanese Patent Applications Laid-Open (JP-A) Nos. 57-112751, 62-200350, 62-206541, and 62-206543, a low-sensitivity emulsion layer may be located more distant from the support than a high-sensitivity emulsion layer.

Specifically, photosensitive layers are arranged, toward the support, in the order of a low-sensitivity blue photosensitive layer (BL), a high-sensitivity blue photosensitive layer (BH), a high-sensitivity green photosensitive layer (GH), a low-sensitivity green photosensitive layer (GL), a high-sensitivity red photosensitive layer (RH), and a low-sensitivity red photosensitive layer (RL), in the order of BH, BL, GL, GH, RH, and RL, in the order of BH, BL, GH, GL, RL, and RH, or the like.

Photosensitive layers may also arranged in order as described in Japanese Patent Applications Publication (JP-B) Nos. 55-34932 and 49-15495 and Japanese Patent Applications Laid-Open (JP-A) Nos. 56-25738, 62-63936, and 59-202464.

In order to improve color reproduction, a donor layer (CL), which has the interlayer effect and is different in spectral sensitivity from main photosensitive layers such as GL, GL, and RL, is preferably arranged adjacent to or in the proximity of a main photosensitive layer.

A silver halide used in the present invention is preferably silver iodobromide, silver iodochloride, or silver iodochlorobromide, each containing silver iodide of about not more than 30 mol %, more preferably silver iodobromide or silver iodochlobromide, each containing silver iodide of about 2 to 10 mol %.

Silver halide grains in a photographic emulsion may have a regular crystal shape such as cubic, octahedral, and tetradecahedral, an irregular crystal shape such as spherical and tabular, or a crystal shape having crystal defect such as twinned crystal planes, or their combined shape.

Silver halide grains may have a fine size of about not more than 0.2 μm or a relatively large size of up to about 10 μm in a projected area diameter, and may be in the form of either a multidisperse emulsion or a monodisperse emulsion.

A silver halide photographic emulsion usable in the present invention may be prepared by methods described, for example, in "I. Emulsion Preparation and Types," Research Disclosure (hereinafter referred to as RD) No. 17643 (December 1978), pp. 22–23, RD No. 18716 (November 1979), p. 648, and RD No. 307105 (November 1989), pp. 863–865.

Also preferred are monodisperse emulsions described in U.S. Pat. Nos. 3,574,628 and 3,655,394 and British Patent No. 1,413,748. Further, tabular grains having an aspect ratio of about not less than 3 are usable in the present invention.

The crystal structure may be uniform or may comprise halide compositions having heterogeneous interior and exterior or may be a layered structure. Silver halides having different compositions may be junctioned together through epitaxial junction. For example, a silver halide may be junctioned with other than a silver halide, for example, with silver rhodanide or lead oxide. Also, a mixture of grains having different crystal shapes may be used.

The above-described emulsions may be either a surface latent image type, wherein a latent image is primarily formed on the surface of grains, or an internal latent image type, wherein a latent image is formed in the interior of grains, or a composite type, wherein a latent image is formed on either of the surface and interior of grains. However, the emulsions must be a negative type. Internal latent image type emulsions may be a core/shell type as described in Japanese Patent Application Laid-Open (JP-A) No. 63-264740. A method for preparing internal latent image type emulsions of the core/shell type is described in Japanese Patent Application Laid-Open (JP-A) No. 59-133542. The thickness of a shell for this type of emulsions depends on development and is preferably 3 to 40 nm, more preferably 5 to 20 nm.

Silver halide emulsions to be used normally undergo physical ripening, chemical ripening, and spectral sensitization. Additives used in these steps are described in RD No. 17643, RD No. 18716, and RD No. 307105, and relevant pages in RD are listed in the table given below.

In photosensitive materials of the present invention, two or more kinds of emulsions which are different in at least one of the grain size of a photosensitive silver halide emulsion, grain size distribution, halide composition, grain shape, and sensitivity may be mixedly used within the same layer.

Surface-fogged silver halide grains described in U.S. Pat. No. 4,082,553, internally fogged silver halide grains described in Japanese Patent Application Laid-Open (JP-A) No. 59-214852, and colloidal silver are preferably applied to a photosensitive silver halide emulsion layer and/or a substantially non-photosensitive hydrophilic colloid layer. Internally fogged or surface fogged silver halide grains mean uniformly (non-imagewisely) developable silver halide grains irrelative to an unexposed portion and an exposed portion of a photosensitive material. A method for preparing such silver halide grains is described in U.S. Pat. No. 4,626,498 and Japanese Patent Application Laid-Open (JP-A) No. 59-214852. Internally fogged core/shell type silver halide grains may be different in halide composition for silver halide, which forms a core of the grains. Any of silver chloride, silver chlorobromide, silver iodobromide, and silver chloroiodobromide can be used for internally fogged or surface-fogged silver halide. The average grain size of these fogged silver halide grains is 0.01 to 0.75 μm, preferably 0.05 to 0.6 μm. The grains may have a regular shape, and may be in the form of a multi-disperse emulsion, but is preferably in the form of a monodisperse emulsion (at least 95% in terms of weight or quantity of silver halide grains have an average grain size ±40%).

Photosensitive materials of the present invention preferably have a silver coating quantity of 2.0 to 6.0 g/m$^2$, more preferably 2.5 to 4.5 g/m$^2$.

Photographic additives usable in the present invention are also described in RDs. Relevant pages are listed in the table below.

| Additives | RD17643 | RD18716 | RD307105 |
|---|---|---|---|
| 1. Chemical sensitizers | p. 23 | right column, p. 648 | p. 866 |
| 2. Sensitivity increasing agents | | right column, p. 648 | |
| 3. Spectral sensitizers, supersensitizers | pp. 23–24 to right | right column, p. 648 column, p. 649 | pp. 866–868 |
| 4. Brightening agents | p. 24 | right column, p. 647 | p. 868 |
| 5. Light absorbing agents, filter dyes, ultraviolet light absorbing agents | pp. 25–26 p. 650 | right column, p. 649 to left column, | p. 873 |
| 6. Binders | p. 26 | left column, p. 651 | pp. 873–874 |
| 7. Plasticizers, lubricants | p. 27 | right column, p. 650 | p. 876 |
| 8. Coating aids, surfactants | pp. 26–27 | right column, p. 650 | pp. 875–876 |
| 9. Antistatic agents | p. 27 | right column, p. 650 | pp. 876–877 |
| 10. Matting agents | | | pp. 878–879 |

A variety of dye-forming couplers can be used for photosensitive materials of the present invention. Particularly, the following dye-forming couplers are preferred.

Yellow dye-forming couplers: couplers represented by formulas (I) and (II) in EP 502,424A; couplers represented by formulas (1) and (2) (particularly Y-28 on page 18) in EP 513,496A; coupler represented by formula (I) in claim 1 in EP 568,037A; coupler represented by general formula (I) on lines 45–55 in column 1 in U.S. Pat. No. 5,066,576; coupler represented by general formula (I) in paragraph 0008 in Japanese Patent Application Laid-Open (JP-A) No. 4-274425; couplers described in claim 1 on page 40 (particularly D-35 on page 18) in EP 498,381A1; couplers represented by formula (Y) on page 4 (particularly Y-1 on page 17 and Y-54 on page 41) in EP 447,969A1; couplers represented by formulas (II) to (IV) on lines 36–58 in column 7 (particularly II-17 and -19 in column 17 and II-24 in column 19) in U.S. Pat. No. 4,476,219.

Magenta dye-forming couplers: L-57 (lower right of page 11), L-68 (lower right of page 12), and L-77 (lower right of page 13) in Japanese Patent Application Laid-Open (JP-A) No. 3-39737; [A-4]-63 on page 134 and [A-4]-73 and -75 on page 139 in EP 456,257; M-4 and -6 on page 26 and M-7 on page 27 in EP 486,965; M-45 on page 19 in EP 571,959A; M-1 on page 6 in Japanese Patent Application Laid-Open (JP-A) No. 5-204106; M-22 in paragraph 0237 in Japanese Patent Application Laid-Open (JP-A) No. 4-362631.

Cyan dye-forming couplers: CX-1, -3, -4, -5, -11, -12, -14, and -15 on pages 4–16 of Japanese Patent Application Laid-Open (JP-A) No. 4-204843; C-7 and -10 on page 35, C-34 and -35 (page 37), and I-1 and I-17 on pages 42–43 in Japanese Patent Application Laid-Open (JP-A) No. 4-43345; coupler represented by general formula (Ia) or (Ib) in claim 1 in Japanese Patent Application Laid-Open (JP-A) No. 6-67385.

Polymer couplers: P-1 and P-5 on page 11 in Japanese Patent Application Laid-Open (JP-A) No. 2-44345.

As couplers providing an adequate diffusivity of color dye are preferred couplers described in U.S. Pat. No. 4,366,237, British Patent No. 2,125,570 and EP 96,873B.

As couplers for compensating for unwanted absorption of color dye are preferred yellow colored cyan couplers represented by formulas (CI), (CII), (CIII), and (CIV) on page 5 (particularly YC-86 on page 84) in EP 456,257A1, yellow colored magenta couplers ExM-7 (page 202), Ex-1 (page 249), and EX-7 (page 251) described in EP 456,257A1, magenta colored cyan couplers CC-9 (column 8) and CC-13 (column 10) described in U.S. Pat. No. 4,833,069, compound (2) (column 8) in U.S. Pat. No. 4,837,136, and colorless masking couplers represented by formula (A) in claim 1 (particularly compounds exemplified on pages 36–45) in WO 92/11575.

Compounds (including couplers) which release photographically useful residual chemical groups upon reaction with an oxidation product of a developing agent are listed below. Development inhibitor releasing compounds: compounds represented by formulas (I), (II), (III), and (IV) on page 11 (particularly T-101 (page 30), T-104 (page 31), T-113 (page 36), T-131 (page 45), T-144 (page 51), and T-158 (page 58)) in EP 378,236A1, compounds represented by formula (I) on page 7 (particularly D-49 (page 51)) in EP 436,938A2, compounds represented by formula (1) (particularly (23) on page 11) in EP 568,037A, and compounds represented by formulas (I), (II), and (III) on pages 5–6 (particularly I-(1) on page 29) in EP 440,195A2; bleach-accelerating agent releasing compounds: compounds represented by formulas (I) and (I') on page 5 (particularly (60) and (61) on page 61) in EP 310,125A2 and compounds represented by formula (I) in claim 1 (particularly (7) on page 7) in Japanese Patent Application Laid-Open (JP-A) No. 6-59411; ligand releasing compounds: compounds represented by LIG-X described in claim 1 (particularly compounds on lines 21–41 in column 12) in U.S. Pat. No. 4,555,478; leuco dye releasing compounds: compounds 1 to 6 in columns 3–8 in U.S. Pat. No. 4,749,641; fluorescent dye releasing compounds: compounds represented by COUP-DYE in claim 1 (particularly compounds 1 to 11 in columns 7–10) in U.S. Pat. No. 4,774,181; development accelerators or fogging agent releasing compounds: compounds represented by formulas (1), (2), and (3) in column 3 (particularly (I-22) in column 25) in U.S. Pat. No. 4,656,123 and ExZK-2 on lines 36–38 on page 75 in EP 450,637A2; compounds which release a group which becomes a dye upon elimination: compounds represented by formula (1) in claim 1 (particularly Y-1 to Y-19 in columns 25–36) in U.S. Pat. No. 4,857,447.

The following compounds are preferred as additives other than couplers.

Dispersing media for oil soluble organic compounds: P-3, -5, -16, -19, -25, -30, -42, -49, -54, -55, -66, -81, -85, -86, and -93 (pages 140–144) in Japanese Patent Application Laid-Open (JP-A) No. 62-215272; latex for impregnation of oil soluble organic compounds: latex described in U.S. Pat. No. 4,199,363; scavengers for oxidation product of a developing agent: compounds represented by formula (I) on lines 54–62 in column 2 (particularly I-(1), -(2), -(6), and -(12) in columns 4–5) in U.S. Pat. No. 4,978,606, and compounds represented by a formula on lines 5 to 10 in column 2 (particularly compound 1 in column 3) in U.S. Pat. No. 4,923,787; stain inhibitors: compounds represented by formulas (I) to (III) on lines 30–33 on page 4 (particularly I-47 and -72 and III-1 and -27 on pages 24–48) in EP 298,321A; discoloration preventives: A-6, -7, -20, -21, -23, -24, -25, -26, -30, -37, -40, -42, -48, -63, -90, -92, -94, and -164 (pages 69–118) in EP 298,321A, II-1 to III-23 (particularly III-10) in columns 25–38 in U.S. Pat. No. 5,122,444, I-1 to III-4 (particularly II-2) on pages 8–12 in EP 471,347A, and A-1 to A-48 (particularly A-39 and -42) in columns 32–40 in U.S. Pat. No. 5,139,931; materials for reducing the amounts of color intensifiers or color mixing inhibitors: I-1 to II-15, particularly I-46, on pages 5–24 in EP 411,324A; formalin scavengers: SCV-1 to -28, particularly SCV-8, on pages 24–29 in EP 477,932A; hardening agents: H-1, -4, -6, -8, and -14 on page 17 in Japanese Patent Application Laid-Open (JP-A) No. 1-214845, compounds H-1 to -54 represented by formulas (VII) to (XII) in columns 13–23 in U.S. Pat. No. 4,618,573, compounds H-1 to -76 (particularly H-14) represented by formula (6) shown at lower right column of page 8 in Japanese Patent Application Laid-Open (JP-A) No. 2-214852, and compounds described in claim 1 in U.S. Pat. No. 3,325,287; precursors of development inhibitors: P-24, -37, and -39 (pages 6–7) in Japanese Patent Application Laid-Open (JP-A) No. 62-168139; compounds described in claim 1 (particularly 28 and 29 in column 7) in U.S. Pat. No. 5,019,492; antiseptics and mildewproofing agents: I-1 to III-43, particularly II-1, -9, -10, and -18, and III-25, in columns 3–15 in U.S. Pat. No. 4,923,790; stabilizers and antifoggants: I-1 to (14) (particularly I-1, 60, (2), (13)) in columns 6–16 in U.S. Pat. No. 4,923,793, and compounds 1 to 65 (particularly 36) in columns 25–32 in U.S. Pat. No. 4,952,483; chemical sensitizers: triphenylphosphine selenide, and compound 50 described in Japanese Patent Application Laid-Open (JP-A) No. 5-40324; dyes: a-1 to b-20 (particularly a-1, -12, -18, -27, -35, and -36, and b-5) on pages 15–18 and V-1 to -23 (particularly V-1) on pages 27–29 in Japanese Patent Application Laid-Open (JP-A) No. 3-156,450, F-I-1 to F-II-43 (particularly F-I-11 and F-II-8) on pages 33–55 in EP 445,627A, III-1 to -36 (particularly III-1 and -3) on pages 17–28 in EP 457,153A, and microcrystal dispersion of Dye-1 to -124 in 8 to 26 in WO 88/04794, compounds 1 to 22 (particularly compound 1) on pages 6–11 in EP 319,999A, compounds D-1 to -87 represented by formulas (1) to (3) (pages 3–28) in EP 519,306A, compounds 1 to 22 represented by formula (I) (columns 3–10) in U.S. Pat. No. 4,268,622, and compounds (1) to (31) represented by formulas (I) (columns 2–9) in U.S. Pat. No. 4,923,788; ultraviolet light absorbing agents: compounds (18b) to (18r) and 101 to 427 represented by formula (1) (pages 6–9) in Japanese Patent Application Laid-Open (JP-A) NO. 46-3335, compounds (3) to (66) represented by formula (I) (pages 10–44) and compounds HBT-1 to -10 represented by formula (III) (page 14) in EP 520,938A, and compounds (1) to (31) represented by formula (1) (columns 2–9) in EP 521,823A.

In order to simplify and accelerate processing, silver halide photosensitive materials of the present invention may contain a color developing agent. Preferably, a variety of precursors of a color developing agent are used. Examples of these precursors include indoaniline type compounds described in U.S. Pat. No. 3,342,597, Schiff base type compounds described in U.S. Pat. No. 3,342,599 and Research Disclosure Nos. 14,850 and 15,159, aldol compounds described in Research Disclosure No. 13,924, metal salt complexes described in U.S. Pat. No. 3,719,492, and urethane type compounds described in Japanese Patent Application Laid-Open (JP-A) No. 53-135628.

In order to accelerate color development, silver halide photosensitive materials of the present invention may contain, as needed, a variety of 1-phenyl-3-pyrazolidone compounds. Typical examples of such compounds are described in Japanese Patent Application Laid-Open (JP-A) Nos. 56-64339, 57-144547, and 58-115438.

The present invention is applicable to any photosensitive materials for color and black-and-white photography, and is applied preferably to color negative films and color reversal films, particularly to color negative films.

The present invention is favorably applicable to film units with lens described in Japanese Patent Application Publication (JP-B) No. 2-32615 and Japanese Utility Model Application Publication (JP-Y) No. 3-39784.

In photosensitive materials of the present invention, hydrophilic colloid layers on the emulsion layer side thereof preferably have a total layer thickness of not more than 28 μm, more preferably not more than 23 μm, further most preferably not more than 18 μm, most preferably not more than 16 μm. Layer swelling speed $T_{1/2}$ is preferably not more than 30 seconds, more preferably not more than 20 seconds.

Photosensitive materials of the present invention preferably have hydrophilic colloid layers (called a backing layer), which have a total layer thickness of 2 to 20 μm after being dried, on the side opposite to the emulsion layer side thereof. Preferably, this backing layer contains the aforementioned light absorbing agent, filter dye, ultraviolet light absorbing agent, antistatic agent, hardening agent, binder, plasticizer, lubricant, coating aid, and surfactant. The backing layer preferably has a degree of swelling of 150 to 500%.

Photosensitive materials of the present invention can be developed by a normal method as described in aforementioned RD No. 17643, pp. 28–29; RD No. 18716, p. 651, left column to right column; and RD No. 307105, pp. 880–881.

A processing method used preferably in the present invention will now be described in detail.

Metal chelate compounds used in processing solutions having a bleaching capability of the present invention are preferably those described in Japanese Patent Application Laid-Open (JP-A) No. 8-110626 and/or European Patent Application Laid-Open No. 713,139A1, more preferably those described in Japanese Patent Application Laid-Open (JP-A) No. 8-110626.

In the present embodiment, metal chelate compounds may be used singly or in combination in a processing solution having a bleaching capability.

When a processing solution having a bleaching capability is a bleaching/fixing solution, in order to markedly exhibit effects (particularly prevention of a leuco dye reciprocity defect) of the present invention, at least one Fe(III) chelate compound of any one of the above-mentioned metal chelate compounds or their salts is preferably used together with ferric complex salt of ethylenediaminetetraacetic acid. Examples of other bleaching agents usable singly or in combination include multivalent metal compounds such as Fe(III), peracid compounds, quinone compounds, and nitro compounds. Typical bleaching agents include: organic complex salts of Fe(III) such as diethylenetriaminepentaacetic acid, cyclohexanediaminetetraacetic acid, methyliminodiacetic acid, glycoletherdiaminetetraacetic acid, and iron complex salts of 1,3-propylenediaminetetraacetic acid described in Japanese Patent Application Laid-Open (JP-A) No. 4-121739, lower right column of page 4 to upper left column of page 5; a carbamoyl type bleaching agent described in Japanese Patent Application Laid-Open (JP-A) No. 4-73647; a heterocyclic bleaching agent described in Japanese Patent Application Laid-Open (JP-A) No. 4-174432; ferric complex salt of N-(2-carboxyphenyl) iminodiacetic acid and bleaching agents described in European Patent Application Laid-Open No. 520457; bleaching agents described in European Patent Application Laid-Open No. 501479; bleaching agents described in European Patent Application Laid-Open No. 567126; bleaching agents described in Japanese Patent Application Laid-Open (JP-A) No. 4-127145; and aminopolycarboxylic acid ferric salt described in Japanese Patent Application Laid-Open (JP-A) No. 3-144446, page 11. Bleaching agents usable in the present invention are not limited thereto.

In embodiments of the present invention, metal chelate compounds may be used in an isolated form or may be allowed to react in a solution with ferric sulfate salt, ferric chloride salt, ferric nitrate salt, ferric phosphate salt, etc. Metal chelate compounds are used at a mole ratio of not less than 1.0 to metal ions. When the stability of metal chelate compounds is relatively low, a larger value of this ratio is preferred. Metal chelate compounds are normally used at this ratio of 1 to 30.

In embodiments of the present invention, a metal chelate compound is used in a processing solution having a bleaching capability preferably at 0.05 to 0.40 mole per liter of the processing solution.

A small amount of a metal chelate compound may be contained in a fixing solution and an intermediate bath placed between a color developing step and a desilvering step.

Examples of a bleaching agent contained in a processing solution having a bleaching capability include inorganic oxidizing agents, such as red prussiate, ferric chloride, dichromate, persulfate, bromate, and hydrogen peroxide, and Fe(III) complex salts of organic acids.

In the present invention, Fe(III) complex salts of organic acids contained in a processing solution having a bleaching capability may be used in the form of alkali metal salt or ammonium salt. Examples of such alkali metal salt include lithium salt, sodium salt, and potassium salt. Examples of such ammonium salt include ammonium salt and tetraethylammonium salt.

In the present invention, an inorganic oxidizing agent as a bleaching agent described above may be used in combination with the above-mentioned Fe(III) complex salts of organic acids as a bleaching agent which is contained in a processing solution having a bleaching capability. When an inorganic oxidizing agent is used with a Fe(III) complex salt of organic acid, the total concentration of the Fe(III) complex salt is preferably 0.005 to 0.050 mol/liter.

A color developing solution used for development in the present invention is preferably an alkali aqueous solution which contains as its principal component an aromatic primary amine type color developing agent. Aminophenol type compounds are usable as this color developing agent, but p-phenylene diamine type compounds are preferably used. Preferred examples of these p-phenylenediamine type compounds include 3-methyl-4-amino-N-ethyl-N-β-hydroxyethylaniline, 4-amino-3-methyl-N-(3-hydroxypropyl)aniline, 4-amino-3-methyl-N-ethyl-N-(4-hydroxybutyl)aniline, 3-methyl-4-amino-N-ethyl-N-β-methanesulphoneamidoethylaniline, and their hydrochlorides, p-toluenesulfonates, or sulfates. More preferred examples of p-phenylene-diamine-based compounds include 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and their hydrochlorides, p-toluenesulfonates, or sulfates. Two or more kinds of these compounds may be used together as needed.

Usage of an aromatic primary amine developing agent is preferably 0.01 to 0.2 mol, more preferably 0.02 to 0.1 mol per liter of a color developing solution. When an aromatic primary amine developing agent is used within this preferred range of usage, a developing speed will be improved while development fogging is suppressed.

In the present invention, it is preferable that a color developing solution substantially should not contain hydroxylamine. The expression "hydroxylamine is not substantially contained" means that the concentration of hydroxylamine is not more than 0.01 mol/liter, preferably not more than 0.005 mol/liter, more preferably not more than 0.001 mol/liter, most preferably zero.

Preferred substitute compounds for hydroxylamine are hydroxylamine derivatives having a substituent, such as an alkyl group, a hydroxyalkyl group, a sulfoalkyl group, or a carboxyalkyl group, specifically N,N-di(sulfoethyl) hydroxylamine, monomethylhydroxylamine, dimethylhydroxylamine, monoethylhydroxylamine, diethylhydroxylamine, and N,N-di(carboxyethyl) hydroxylamine. Among these substitute compounds, N,N-di(sulfoethyl)hydroxylamine is particularly preferred.

In an embodiment of the present invention, a new problem has arisen that when processing is continuously performed in an intermittent manner over a long period of time through use of a color developing solution in which concentration of a color developing agent is increased for reducing the color developing time, a trace of deposit is formed in a processing container and a piping system, resulting in a marked stain on a photosensitive material. However, this problem has been unexpectedly solved through use of a method of processing with a color developing solution which substantially does not contain hydroxylamine.

A color developing solution generally contains a pH buffering agent such as a carbonate, borate or phosphate of an alkali metal; a development inhibitor or an antifoggant such as a chloride salt, a bromide salt, an iodide salt, benzimidazoles, benzothiazoles, or mercapto compounds. Also contained, as needed, are hydroxylamine, diethylhydroxylamine, a hydroxylamine represented by formula (I) in Japanese Patent Application Laid-Open (JP-A) No. 3- 144446, sulfite, hydrazines such as N,N-biscarboxymethyl hydrazine, phenylsemicarbazides, triethanolamine, a variety of preservatives including a catecholsulfonic acid, organic solvents such as ethyleneglycol and diethylene glycol, development accelerators such as benzyl alcohol, polyethylene glycol, a quaternary ammonium salt and an amine, dye forming couplers, competitive couplers, an auxiliary developing agent such as 1-phenyl-3-pyrazolidone, a thickener, a variety of chelating agents represented by aminopolycarboxylic acid, aminopolyphosphonic acid, alkylphosphonic acid, and phosphonocarboxylic acid. Typical examples of such chelating agents include ethylenediaminetetraacetic acid, nitrotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and their salts.

In the present invention, the temperature of processing in a color developing solution is 20° to 55° C., preferably 30° to 50° C. In view of rapid processing, the processing time is 10 seconds to 3 minutes and 30 seconds, preferably 20 seconds to 2 minutes and 30 seconds, more preferably 30 seconds to 1 minute and 30 seconds.

For reversal process, normally black-and-white development is performed before color development is performed. A known black-and-white developing agent can be used for this development. Examples of such a known black-and-white developing agent include dihydroxybenzene compounds such as hydroquinone and hydroquinone monosulphonate, 3-pyrazolidone compounds such as 1-phenyl-3-pyrazolidone and 1-phenyl-4-methyl-4-hydroxymethyl-3-pyrazolidone, and aminophenol compounds such as N-methyl-p-aminophenol. These known black-and-white developing agents may be used singly or in combination.

These color developing solutions and black-and-white developing solutions generally have pH of 9 to 12.

The desilvering process of the present invention is preferably performed immediately after color development, but is generally performed in a conditioning bath (a bleach-accelerating bath and a prebleaching bath may also be used as conditioning baths) when a reversal process is involved. An conditioning stabilizer using a dye image stabilizing agent, which will be described hereinafter, is preferably used in these conditioning baths because of a resultant improvement in dye image stability.

In addition to a dye image stabilizing agent, a conditioning solution can contain aminopolycarbonic acid chelating agents such as ethylenediaminetetraacetic acid, diethylenetriaminepentaacetic acid, 1,3-propylenediaminetetraacetic acid, or cyclohexanediaminetetraacetic acid, sulfite such as sodium sulfite or ammonium sulfite, and any of bleach-accelerating agents such as thioglycerol, aminoethanethiol, and sulfoethanethiol, which will be described later. In order to prevent scum, the conditioning solution preferably contains sorbitan esters of ethyleneoxy-substituted fatty acid described in U.S. Pat. No. 4,839,262, and a polyoxyethylene compound described in U.S. Pat. No. 4,059,446 and Research Disclosure, vol. 191, 19104 (1980). These compounds can be used within the range of 0.1–20 g per liter of a conditioning solution, but is preferably used within the range of 1–5 g per liter.

A conditioning bath is normally used within a pH range of 3 to 11, preferably 4 to 9, more preferably 4.5 to 7. A processing time in a conditioning bath is preferably 20 seconds to 5 minutes, more preferably 20 seconds to 100 seconds, most preferably 20 seconds to 60 seconds. A processing temperature of a conditioning bath is preferably 20° to 50° C., more preferably 30° to 40° C.

In the present invention, an imagewisely exposed photosensitive material is processed in a color developing solution, desilvered, and then washed and/or processed in a stabilizer.

Basically, a photosensitive material is bleached in a processing solution having a bleaching capability in a desilvering process, and subsequently undergoes a fixing process in a processing solution having a fixing capability. The bleaching process and the fixing process may be performed independently, or may be performed simultaneously in a bleaching/fixing solution having both bleaching and fixing capabilities (bleaching/fixing process). The bleaching process, the fixing process, and the bleaching/fixing process may consist of one step or more than one step.

In the present invention, a processing solution having a bleaching capability refers to a processing solution which contains a bleaching agent and used in a desilvering step, specifically a bleaching solution and a bleaching/fixing solution. In order to markedly exhibit effects of the present invention, the processing solution having a bleaching capability is preferably a bleaching/fixing solution.

A processing solution having a fixing capability refers to a processing solution which contains a fixing agent and is used in a desilvering step, specifically a fixing solution and a bleaching/fixing solution.

In the present invention, the desilvering process is performed in the following modes of steps, but is not limited thereto.

1. Bleaching and fixing
2. Bleaching/fixing
3. Bleaching and bleaching/fixing
4. Bleaching/fixing and bleaching/fixing
5. Bleaching, bleaching/fixing, and fixing
6. Bleaching, bleaching/fixing, and bleaching/fixing
7. Bleaching, fixing, and bleaching/fixing
8. Bleaching/fixing and fixing 9b. Bleaching, fixing, and fixing 10. Bleaching/fixing and bleaching A washing step may be interposed between steps in each mode listed above.

In the present invention, the above mode 2 is most preferable in view of a reduction of a desilvering time as well as the size of an apparatus.

In the present invention, a processing temperature in a processing solution having a bleaching capability is 20° to 55° C., preferably 30° to 50° C. In view of acceleration of processing, a processing time is preferably within the range from 10 seconds to 2 minutes, more preferably within the range from 20 seconds to 1 minute and 30 seconds.

According to the present invention, a processing solution having a bleaching capability contains a metal chelate compound as a bleaching agent, and preferably further contains halide such as chloride, bromide, or iodide as a re-halogenating agent for accelerating oxidation of silver. In place of halide, an organic ligand to form slightly soluble silver salt may be added. The halide is added in the form of an alkali metal salt, an ammonium salt, a guanidine salt, or an amine salt. Specific examples of these halides include sodium bromide, ammonium bromide, potassium chloride, guanidine hydrochloride, potassium bromide, and potassium chloride. In the present invention, a processing solution having a bleaching capability adequately contains a re-halogenating agent in the amount of not more than 2 mol/liter, and a bleaching solution contains it preferably in the amount of 0.01 to 2.0 mol/liter, more preferably 0.1 to 1.7 mol/liter, most preferably 0.1 to 0.6 mol/liter. A bleaching/fixing solution contains it preferably in the amount of 0.001 to 2.0 mol/liter, more preferably 0.001 to 1.0 mol/liter, most preferably 0.001 to 0.5 mol/liter.

According to the present invention, a bleach-accelerating agent, a corrosion inhibitor to prevent corrosion of a processing tank, a buffering agent to maintain a solution at a predetermined pH, a fluorescent whitening agent, a defoaming agent, etc. are added, as needed, to a processing solution having a bleaching capability or its preceding bath.

Bleach-accelerating agents usable in the present invention include: compounds having a mercapto group or a disulfido group described in U.S. Pat. No. 3,893,858, German Patent No. 1,290,821, British Patent No. 1,138,842, Japanese Patent Application Laid-Open (JP-A) No. 53-95630, and Research Disclosure No. 17129 (July, 1978); thiazolidine derivatives described in Japanese Patent Application Laid-Open (JP-A) No. 50-140129; thiourea derivatives described in U.S. Pat. No. 3,706,561; iodides described in Japanese Patent Application Laid-Open (JP-A) No. 58-16235; polyethylene oxide compounds described in German Patent No. 2,748,430; and polyamine compounds described in Japanese Patent Application Publication (JP-B) No. 45-8836. Compounds described in U.S. Pat. No. 4,552,834 are also preferable. These bleach-accelerating agents may be added into a photosensitive material. These bleach-accelerating agents are particularly effective for the case where a color photosensitive material for photographing undergoes bleaching/fixing. Particularly preferable are mercapto compounds described in British Patent No. 1,138,842 and Japanese Patent Application Laid-Open (JP-A) No. 2-190856.

An organic acid having two or more carboxyl groups is used in a processing solution having a bleaching capability in the present invention. Examples of such an organic acid include oxalic acid, malonic acid, succinic acid, glutaric acid, adipic acid, maleic acid, fumaric acid, aspartic acid, citric acid, and 2,6-pyridine dicarboxylic acid. They may be used in combinations of two to four.

In the present invention, a processing solution having a bleaching capability may contain an organic acid of pKa 2.0 to 5.5, such as acetic acid, glycollic acid, or propionic acid, as well as a dicarboxylic acid compound. Such organic acids may be used singly or in combination, and are contained as a buffering agent(s) preferably in the amount of 0.05 to 2.0 mol/liter, more preferably 0.1 to 1.5 mol/liter.

In the present invention, a bleaching solution or a bleaching/fixing solution has pH of 2.0 to 8.0, preferably 3.0 to 7.5. When an imagewisely exposed photosensitive material undergoes bleaching or bleaching/fixing immediately after color development, in order to suppress bleach fog, the bleaching or bleaching/fixing solution has pH of not more than 7.0, preferably not more than 6.4. Particularly, the bleaching solution preferably has pH of 3.0 to 5.0. If pH of the bleaching or bleaching/fixing solution is not more than 2.0, the metal chelates used in the present invention may tend to become unstable. Thus, their pH is preferably 2.0 to 6.4.

In order to attain the above-described pH requirements, any pH buffering agent may be used so long as it is less likely to be oxidized by a bleaching agent and provides a buffering effect within the above described pH range. Examples of such a pH buffering agent include the aforementioned dicarboxylic acid compounds, organic acid compounds such as acetic acid, glycollic acid, lactic acid, propionic acid, and butyric acid; and organic bases such as pyridine and imidazole. These buffering agents may be used in combination.

In order to regulate pH of a processing solution having a bleaching capability within the above-mentioned ranges, the above-mentioned acid and an alkali agent (for example, aqueous ammonia, KOH, NaOH, potassium carbonate, sodium carbonate, imidazole, monoethanolamine, or diethanolamine) may be used in combination. As for a corrosion inhibitor, nitrate is preferably used as described in Japanese Patent Application Laid-Open (JP-A) No. 3-33847. Ammonium nitrate, sodium nitrate, and potassium nitrate are also used as a corrosion inhibitor. In view of reducing an amount of discharge of nitrogen atoms into the environment, it is desirable that substantially no ammonium ions be contained in a processing solution of the present invention.

In the present invention, the expression "substantially no ammonium ions are contained" means that the concentration of ammonium ions is preferably not more than 0.01 mol/liter, particularly preferably zero.

A kit for preparing a processing solution having a bleaching capability for use in the present invention may be in either liquid or powder. When an ammonium salt is removed from the kit, most materials for preparing a processing solution are supplied in powder and thus are easily powdered because of their lower hygroscopicity.

The concentration of a fixing agent in a processing solution having a fixing capability is 0.2 to 3.0 mol per liter of a bleaching/fixing solution or a fixing solution, preferably 0.5 to 2.0 mol/liter, more preferably 0.8 to 1.8 mol/liter. While the concentration of a fixing agent is maintained within these preferable ranges, a desilvering speed is increased, and the occurrence of stain after processing is effectively prevented.

Generally, ammonium thiosulfate has been used as a fixing agent for use in a desilvering step. However, it may be replaced by known other fixing agents, for example, mesoionic compounds, thioether type compounds, thiourea type compounds, a large amount of iodide, and hypo. These known fixing agents are described in Japanese Patent Application Laid-Open (JP-A) Nos. 60-61749, 60-147735, 64-21444, 1-201659, 1-210951, and 2-44355, and U.S. Pat. No. 4,378,424. Further, fixing can be accelerated by using fixing agents in combination. For example, ammonium thiosulfate or sodium thiosulfate is preferably combined with a second fixing agent such as sodium thiocyanate, imidazole, thiourea, or thioether. In this case, the second fixing agent is preferably added in the amount of 0.01 to 100 mol % to ammonium thiosulfate or sodium thiosulfate.

A pH value of a fixing agent, which depends on a fixing agent, is preferably 5.8 to 8.0 to obtain stable fixing performance for the case where thiosulfate is used as a fixing agent.

A preservative may be added to a bleaching/fixing solution or a fixing solution to thereby improve stability against aging of the solution. For a bleaching/fixing solution or a fixing solution which contains thiosulfate, an effective preservative is sulfite and/or a bisulfite adduct of hydroxylamine, hydrazine, or aldehyde (for example, a bisulfite adduct of acetaldehyde, particularly preferably a bisulfite adduct of aromatic aldehyde described in Japanese Patent Application Laid-Open (JP-A) No. 3-158848).

Preferably, a bleaching/fixing solution and a fixing solution used in the present invention which contain a metal chelate compound contain at least one kind of sulfinic acid and its salt. Examples of preferred compounds of sulfinic acid and its salt include compounds described in Japanese Patent Application Laid-Open (JP-A) Nos. 1-230039, 1-224762, 1-231051, 1-271748, 2-91643, 2-251954, 2-251955, 3-55542, 3-158848, 4-51237, and 4-329539, U.S. Pat. Nos. 5,108,876 and 4,939,072, and EP Nos. 255,722A and 463,639.

In the present invention, the concentration of ammonium ions in a processing solution having a fixing capability ranges preferably from 0.0 to 1.0 mol/liter, more preferably from 0.0 to 0.5 mol/liter. Particularly, a processing solution having a fixing capability which contains no ammonium ions is preferred.

In the present invention, a processing temperature in a processing solution having a fixing capability is 20° to 55° C., preferably 30° to 50° C. In view of acceleration of processing, a processing time is preferably within the range from 10 seconds to 2 minutes, more preferably within the range from 20 seconds to 1 minutes and 30 seconds.

A processing solution having a fixing capability may contain a fluorescent whitening agent, a defoaming agent or a surfactant, and an organic solvent such as polyvinyl pyrrolidone or methanol. Preferably, in order to stabilize a processing solution having a fixing capability, the processing solution preferably contains a chelating agent selected from a variety of aminopolycarboxylic acid compounds and organic phosphonic acid compounds. Preferred chelating agents include 1-hydroxyethylidene-1,1-diphosphonic acid, ethylenediamine-N,N,N',N'-tetrakis(methylenephosphonic acid), nitrotrimethylenephosphonic acid, ethylenediaminetetraacetic acid, diethylenetriaminepentaacetic acid, cyclohexanediaminetetraacetic acid, and 1,2-propylenediaminetetraacetic acid.

Preferably, a buffering agent is added to a processing solution having a fixing capability, in order to maintain it at a constant pH. Examples of such a buffering agent include phosphates, imidazole compounds such as imidazole, 1-methyl-imidazole, 2-methyl-imidazole, and 1-ethylimidazole, triethanolamine, N-allylmorpholine, and N-benzoylpiperazine.

A total time of desilvering steps is preferably minimized so long as no poor desilverization occurs. The total time is preferably 10 seconds to 2 minutes, more preferably 10 seconds to 1 minute and 30 seconds. A desilvering temperature is 30° C. to 50° C., preferably 35° C. to 45° C. While a desilvering temperature is maintained within these preferable ranges, a desilvering speed is increased, and the occurrence of stain after processing is effectively prevented.

In the present invention, after being desilvered, a photosensitive material undergoes a washing step and/or a stabilizing step. Usage of water in a washing step can be set in a wide range according to characteristics of a photosensitive material (for example, materials used such as couplers), application, a washing water temperature, the number of washing steps, and other various conditions.

In an intermittent processing, an increased time of water stagnation causes the propagation of bacteria, resulting in the adhesion of generated suspended matter to a photosensitive material or a like problem. In order to solve such a problem, a method of the present invention for processing color photosensitive materials can quite effectively employ a method of reducing calcium ions and magnesium ions as described in Japanese Patent Application Laid-Open (JP-A) No. 62-288838. Also, isothiazolone compounds as described in Japanese Patent Application Laid-Open (JP-A) No. 57-8542, thiabendazole compounds, chlorine-based disinfectants such as chlorinated sodium isocyanurate, and other disinfectants such as benzotriazole can be used.

In the present invention, water used in the above-described washing step has pH of 3 to 9, preferably 4 to 8. In view of acceleration of washing, washing is performed at a washing water temperature of 15° to 50° C. for 5 seconds to 1 minute, preferably at 25° to 45° C. for 5 to 40 seconds.

When the desilvering step of the present invention comprises a single bleaching/fixing step, the bleaching/fixing step is preferably directly followed by a stabilizing step without placing a washing step therebetween.

Such stabilization can employ all known methods described in Japanese Patent Application Laid-Open (JP-A) Nos. 57-8543, 58-14834, and 60-220345.

In a method of the present invention for processing photosensitive materials, a stabilizer preferably has pH of 4.0 to 5.5, more preferably 4.2 to 5.3. If pH of a stabilizer falls within these ranges, effects of the present invention will be markedly exhibited.

An organic acid having two or more carboxyl groups is used in such a stabilizer. Examples of such an organic acid include oxalic acid, malonic acid, succinic acid, glutaric acid, adipic acid, maleic acid, fumaric acid, aspartic acid, citric acid, and 2,6-pyridine dicarboxylic acid. They may be used in combination of two to four.

The stabilizer may contain an organic acid of pKa 2.0 to 5.5, such as acetic acid, glycollic acid, or propionic acid, as well as a dicarboxylic acid compound.

Such organic acids may be used singly or in combination, and are contained as a buffering agent(s) preferably in the amount of 0.001 to 0.2 mol/liter, more preferably 0.005 to 0.15 mol/liter.

In order to regulate pH of the stabilizer within the above-mentioned ranges, the above-mentioned acid and an alkali agent (for example, aqueous ammonia, KOH, NaOH, potassium carbonate, sodium carbonate, imidazole, monoethanolamine, or diethanolamine) may be used in combination. Particularly, aqueous ammonia, KOH, NaOH, potassium carbonate, and sodium carbonate are preferable.

A stabilizer also contains compounds for stabilizing dye images. Examples of such compounds include formalin, a benzaldehyde such as m-hydroxybenzaldehyde, a bisulfite adduct of formaldehyde, hexamethylenetetramine and its derivatives, hexahydrotriazine and its derivatives, dimethylolurea, an N-methylol compound such as N-methylolpyrazole, an organic acid, and a pH buffering agent. These compounds are added preferably in the amount of 0.001 to 0.02 mol per liter of a stabilizer. In order to reduce the release of a formaldehyde gas, the concentration of free formaldehyde in a stabilizer is preferably reduced. Accordingly, preferred dye image stabilizers include m-hydroxybenzaldehyde, hexamethylenetetramine, N-methylolazole compounds such as N-methylolpyrazole as described in Japanese Patent Application Laid-Open (JP-A) No. 4-270344, and azolylmethylamine compounds such as N,N'-bis(1,2,4-triazole-1-ylmethyl)piperazine as described in Japanese Patent Application Laid-Open (JP-A) No. 4-313753. Particularly, an azole compound such as 1,2,4-triazole described in Japanese Patent Application Laid-Open (JP-A) No. 4-359249 (corresponding to European Patent Application Laid-Open No. 519,190A2), and N,N'-bis(1,2,4-triazole-1-ylmethyl)piperazine and its derivative are preferably used in combination because of higher dye image stability as well as a lower vapor pressure of formaldehyde. Preferably, a stabilizer also contains, as needed, an ammonium compound such as ammonium chloride or ammonium sulfite, a compound of metal such as Bi or Al, a fluorescent whitening agent, a hardening agent, alkanol amine as described in U.S. Pat. No. 4,786,583, and an aforementioned preservative which can be contained in a fixing solution and a bleaching/fixing solution, for example, a sulfinic acid compound as described in Japanese Patent Application Laid-Open (JP-A) No. 1-231051.

Washing water and a stabilizer can contain a variety of surfactants in order to prevent water marks from being formed on a processed photosensitive material during drying. Among these surfactants, nonionic surfactants are preferred, and alkylphenol ethylene oxide adducts are particularly preferable. For alkylphenol, octyl, nonyl, dodecyl, and dinonyl phenols are particularly preferable. The number in mol of added ethylene oxide is preferably 8 to 14. The use of a silicone-based surfactant, which provides a high defoaming effect, is also preferable.

Preferably, washing water and a stabilizer contain chelating agents. Examples of preferred chelating agents include aminopolycarboxylic acids such as ethylenediaminetetraacetic acid and diethylenetriaminepentaacetic acid, organic phosphonic acids such as 1-hydroxyethylidene-1,1-diphosphonic acid, N,N,N'-trimethylenephosphonic acid, and diethylenetriamine-N,N,N',N'-tetramethylenephosphonic acid, and hydrolysates of maleic anhydride polymer as described in European Patent Application Laid-Open No. 345,172A1.

In the present invention, processing solutions are used at a temperature of 10° to 50° C. A typical temperature range is 33° to 38° C. However, the temperature may be increased to accelerate processing in order to reduce a processing time. On the contrary, the temperature may be reduced to improve image quality as well as stability of processing solutions.

Processing agents for use in the present invention may be supplied in any form. Examples of the form of supply include a solution prepared in a concentration of use or a concentrated solution, granules, powder, tablets, paste, and emulsion. Examples of these processing agents include a solution contained in a container having low oxygen permeability as described in Japanese Patent Application Laid-Open (JP-A) No. 63-17453, vacuum-packed powder or granules as described in Japanese Patent Application Laid-Open (JP-A) Nos. 4-19655 and 4-230748, granules which contain water soluble polymer as described in Japanese Patent Application Laid-Open (JP-A) No. 4-221951, tablets as described in Japanese Patent Application Laid-Open (JP-A) Nos. 51-61837 and 6-102628, and a paste as described in Japanese National Patent Application Laid-Open (JP-A) No. 57-500485. Any of them may be used preferably. However, for convenience of use, a solution prepared in a concentration of use is preferred.

Materials for containers of these processing agents include polyethylene, polypropylene, polyvinyl chloride, polyethylene terephthalate, and nylon. These materials are used singly or in combination. A material is selected according to a required level of oxygen permeability. For containers of solutions susceptible to oxidation such as a color developing solution, materials of low oxygen permeability are preferable. Specifically, composite materials of polyethylene terephthalate or polyethylene and nylon are preferable. Preferably, these materials are used in a thickness of 500 to 1500 μm and have an oxygen permeability of not more than 20 milliliters/$m^2$.24 hrs.atm.

EXAMPLES

The present invention will next be described in detail by way of examples, which however, should not be construed as limiting the invention.

Example 1

(1) Material, etc. of the support

The support used in the present invention was prepared as follows.

PEN: Polyethylene-2,6-naphthalate polymer (100 parts by weight) was compounded with Tinuvin P.326 (Ciba-Geigy; a UV absorber, 2 parts by weight) and bought to dryness. The compound was melted at 300° C. and extruded through a T-shaped die. The extruded material was subjected to longitudinal stretching (×3.3) at 140° C. and subsequently to transversal stretching (×3.3) at 130° C. The resultant stretched film was thermally set at 250° C. for 6 seconds to thereby obtain a PEN film having a thickness of 90 μm. The PEN film contained suitable amounts of blue dyes, magenta dyes, and yellow dyes (I-1, I-4, I-6, I-24, I-26, I-27, II-5 described in Technical Disclosure Bulletin No.94-6023). The film was wound on a stainless steel rod having a diameter of 20 cm, and a thermal hysteresis was applied at 110° C. for 48 hours so as to obtain a support which is resistant to curling.

(2) Undercoating

The thus-obtained support was subjected to corona discharge treatment, UV discharge treatment, and glow discharge treatment, on both surfaces. To each surface of a PEN support was applied, by use of a bar coater, an undercoat solution (10 cc/$m^2$) containing gelatin (coated in an amount of 0.1 g/m$^2$), sodium α-sulfo-di-2-ethylhexylsuccinate (0.01 g/m$^2$), salicylic acid (0.04 g/m$^2$), p-chlorophenol (0.2 g/m$^2$), $(CH_2{=}CHSO_2CH_2CH_2NHCO)_2CH_2$ (0.012 g/m$^2$), and a polyamide-epichlorohydrin polycondensation product (0.02 g/m$^2$). Similarly, to each surface of a TAC support was applied, by use of a bar coater, an undercoat solution (10 cc/m$^2$) containing gelatin (0.2 g/m$^2$), salicylic acid (0.1 g/m$^2$), methanol (15 ml/m$^2$), acetone (85 ml/m$^2$), and formaldehyde (0.01 g/m$^2$). The undercoat layer was provided on the high temperature side during stretching. The coated support was dried at 115° C. for 6 minutes. (The temperature of all the rolls and conveyors in the drying zone was set to 115° C.)

(3) Coating of backing layers

On one surface of the thus-obtained undercoated support, backing layers consisting of an antistatic layer, a magnetic recording layer, and a lubricating layer were provided.

(3-1) Coating of an antistatic layer

An antistatic layer was formed by the application of a mixture containing a fine powder dispersion (coated in an amount of 0.2 g/m$^2$)(diameter of secondary agglomerates: about 0.08 μm) of stannic oxide-antimony oxide complex particles having an average diameter of 0.005 μm and a specific resistance of 5 Ω.cm, gelatin, $(CH_2{=}CHSO_2CH_2CH_2NHCO)_2CH_2$, polyoxyethylene-p-nonylphenol (polymerization degree: 10)(coated in amounts of 0.05 g/m$^2$, 0.02 g/m$^2$, 0.05 g/m$^2$, respectively) and resorcin.

(3-2) Coating of a magnetic recording layer

A magnetic recording layer having a thickness of 1.2 μm was formed by the application, through use of a bar coater, of a mixture containing cobalt-gamma-iron oxide coated with 3-polyoxyethylene-propyloxytrimethoxysilane (polymerization degree: 15) (specific surface area of the coated particles: 43 m$^2$/g, major axis: 0.14 μm, minor axis: 0.03 μm, saturation magnetization: 89 emu/g, $Fe^{+2}/Fe^{+3}$=6/94, the surfaces are treated with 2% by weight, with resect to the weight of the iron oxide, of aluminum oxide-silicone oxide) (coated in an amount of 0.06 g/m$^2$, diacetylcellulose (coated in an amount of 1.2 g/m$^2$)—the iron oxide was dispersed through use of an open kneader and a sand mill—, $C_2H_2C(CH_2OCONH{-}C_6H_3(CH_3)NCO)_3$ (coated in an amount of 0.3 g/m$^2$)(as a setting agent), and solvents therefor (acetone, methylethylketone, and cyclohexanone). The magnetic recording layer also contained the following two matting agents, each in an amount of 10 mg/m$^2$: silica particles (0.3 μm and aluminum oxide particles having a diameter of 0.15 μm (which serve as grinder particles) coated with 15% by weight of 3-polyoxyethylene-propyloxytrimethoxysilane (polymerization degree: 15). Drying was performed at 115° C. for 6 minutes (the temperature of all the rollers and conveyors in the drying zone was set to 115° C.). The increment in color density of $D^B$ in the magnetic recording layer when measured by use of X light (a blue filter) was approximately 0.1. Saturation magnetization moment of the magnetic recording layer was 4.2 emu/g, coercive force was $7.3\times10^4$ A/m, and the square ratio was 65%.

(3-3) Lubricating layer

A lubricating layer was formed by the application of a mixture containing diacetylcellulose (25 mg/m$^2$), $C_6H_{13}CH(OH)C_{10}H_{20}COOC_{40}H_{81}$ (compound a, 6 mg/m$^2$), and $C_{50}H_{101}O(CH_2CH_2O)_{16}H$ (compound b, 9 mg/m$^2$). The mixture was applied in the form of a dispersion, which was prepared by melting the mixture in xylene/propylene monomethyl ether (1/1) at 105° C., pouring the resultant melt into propylene monomethyl ether (10 times in amount) having ambient temperature to form a dispersion, and further diluting the resultant dispersion in acetone (average particle size: 0.01 μm). The lubricating layer also contained the following two matting agents, each in an amount of 15 mg/m$^2$: silica particles (0.3 μm) and aluminum oxide particles (which serve as grinder particles) coated with 15% by weight of 3-polyoxyethylene-propyloxytrimethoxysilane (polymerization degree: 15) (0.15 μm). Drying was performed at 115° C. for 6 minutes (the rollers and conveyors in the drying zone were all set to 115° C.). The resultant lubricant. layer had a dynamic friction coefficient of 0.06 (stainless steel balls having a diameter of 5 mm, load: 100 g, and speed: 6 cm/min), a static friction coefficient of 0.07 (clipping method), and a dynamic friction coefficient of 0.12 between the emulsion layer which will be described below and the lubricating layer, thus exhibiting excellent properties.

(4) Preparation of photosensitive layers (Compositions of photosensitive layers)

Major materials used for the preparation of respective layers are categorized as follows:

ExC: Cyan dye-forming coupler

ExM: Magenta dye-forming coupler

ExY: Yellow dye-forming coupler

ExS: Sensitizing dye

UV: UV absorber

HBS: High-boiling point organic solvent

H: Gelatin hardener

In the descriptions below, the figures corresponding to the respective components indicate the amounts of coating (unit: g/m$^2$). With regard to silver halides, amounts of coating reduced to a silver basis are shown. Amounts of sensitizing dyes are indicated by mols of sensitizing dyes applied to 1 mol of silver halide contained in the same layer.

First layer (Antihalation layer)

| | |
|---|---|
| Black colloidal silver | Silver 0.09 |
| Gelatin | 1.60 |
| ExM-1 | 0.12 |
| ExF-1 | $2.0\times10^{-3}$ |
| Solid dispersion dye ExF-2 | 0.030 |
| Soiid dispersion dye ExF-3 | 0.040 |
| HBS-1 | 0.15 |
| HBS-2 | 0.02 |

-continued
ExM-1
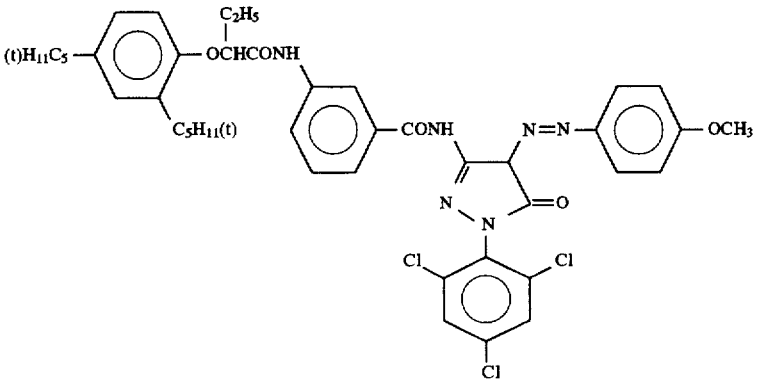
ExF-1
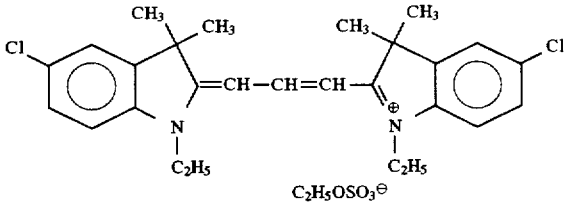
ExF-2
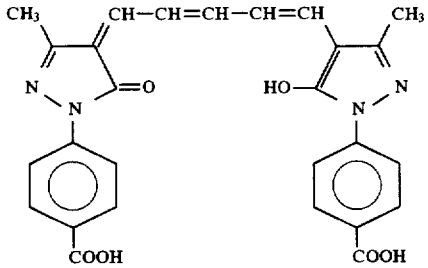
ExF-3
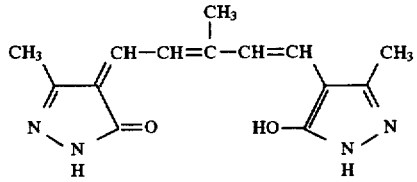
HBS-1 Tricresylphosphate
HBS-2 Di-n-butylphthalate
Second layer (Intermediate layer)
| | |
|---|---|
| Silver iodobromide emulsion M | Silver 0.065 |
| ExC-2 | 0.04 |
| Polyethylacrylate latex | 0.02 |
| Gelatin | 1.04 |

-continued
ExC-2
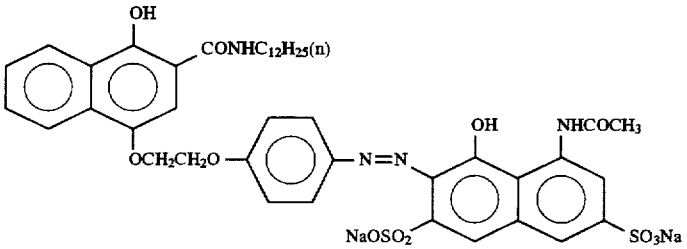
Third layer (Low-sensitive red-sensitive emulsion layer)
| | |
|---|---|
| Silver iodobromide emulsion A | Silver 0.25 |
| Silver iodobromide emulsion B | Silver 0.25 |
| ExS-1 | $6.9 \times 10^{-5}$ |
| ExS-2 | $1.8 \times 10^{-5}$ |
| ExS-3 | $3.1 \times 10^{-5}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
ExS-1
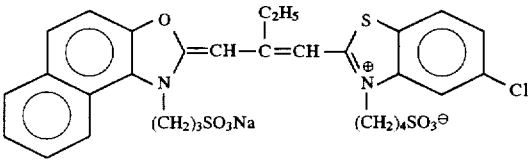
ExS-2
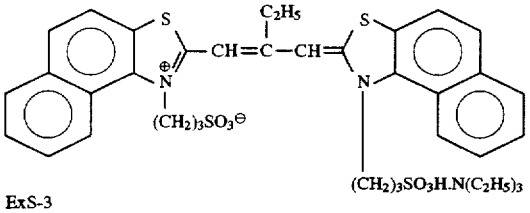
ExS-3
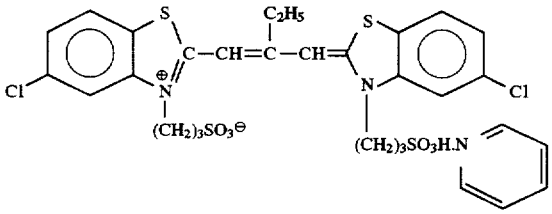
ExC-1
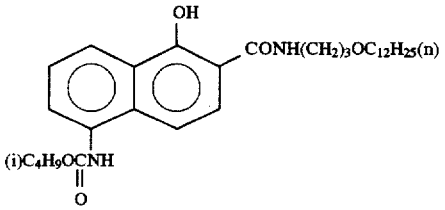

-continued
ExC-3
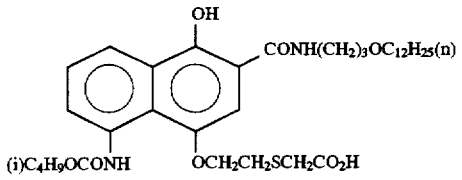
ExC-4
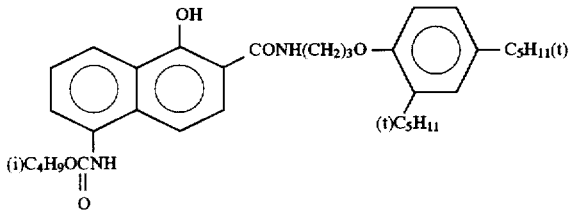
ExC-5
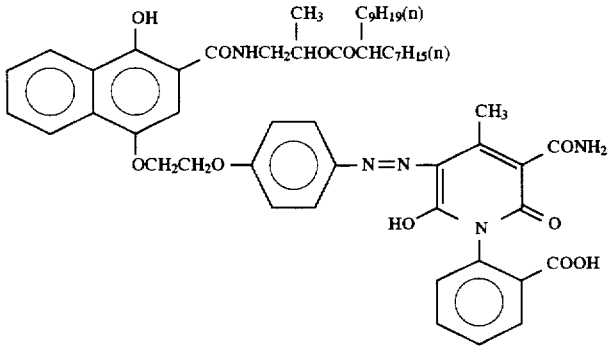
ExC-6
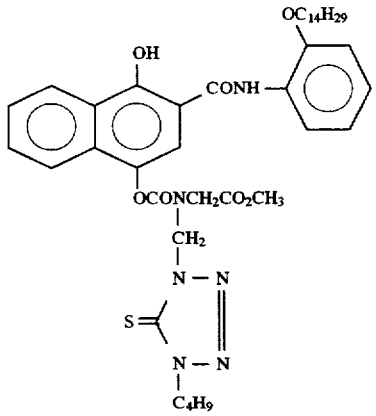
Cpd-2
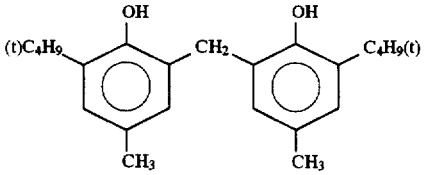

-continued

Fourth layer (Intermediate-sensitive red-sensitive emulsion layer)

| | |
|---|---|
| Silver iodobromide emulsion C | Silver 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |

Fifth layer (High-sensitive red-sensitive emulsion layer)

| | |
|---|---|
| Silver iodobromide emulsion D | Silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |

ExC-7

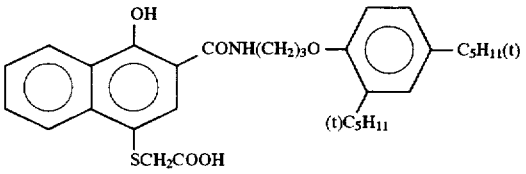

Sixth layer (Intermediate layer)

| | |
|---|---|
| Cpd-1 | 0.090 |
| Solid dispersion dye ExF-4 | 0.030 |
| HBS-1 | 0.050 |
| Polyethylacrylate latex | 0.15 |
| Gelatin | 1.10 |

Cpd-1

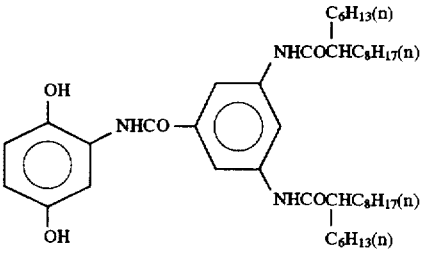

ExF-4

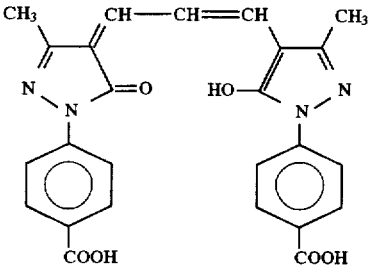

-continued
| Seventh layer (Low-sensitive green-sensitive emulsion layer) | |
|---|---|
| Silver iodobromide emulsion E | Silver 0.15 |
| Silver iodobromide emulsion F | Silver 0.10 |
| Silver iodobromide emulsion G | Silver 0.10 |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
ExS-4
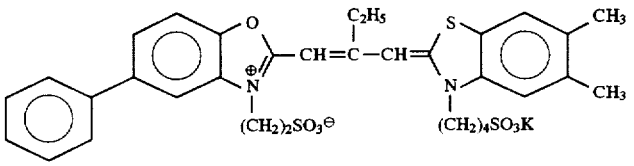
ExS-5
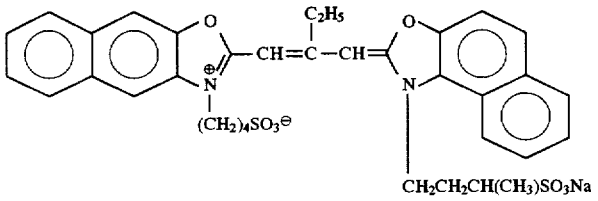
ExS-6
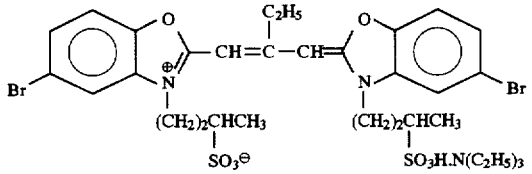
ExM-2
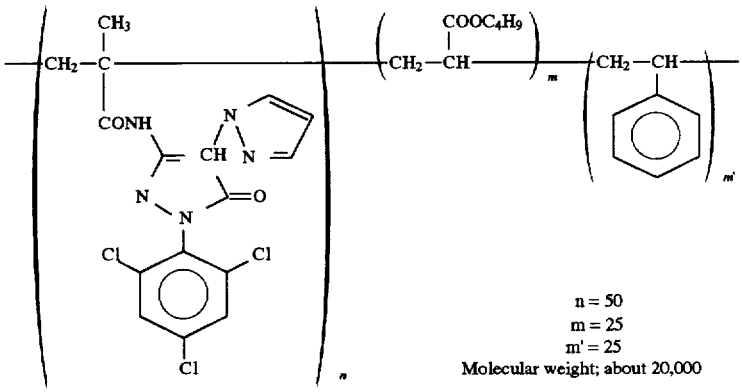
n = 50
m = 25
m' = 25
Molecular weight; about 20,000

-continued
ExM-3
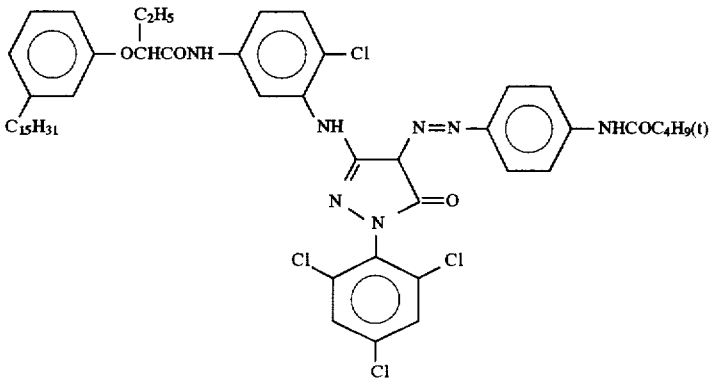
ExY-1
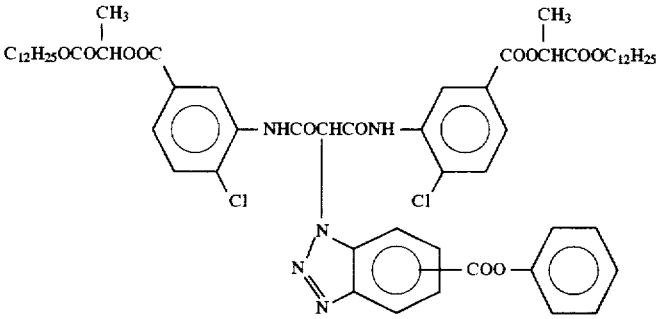
ExC-8
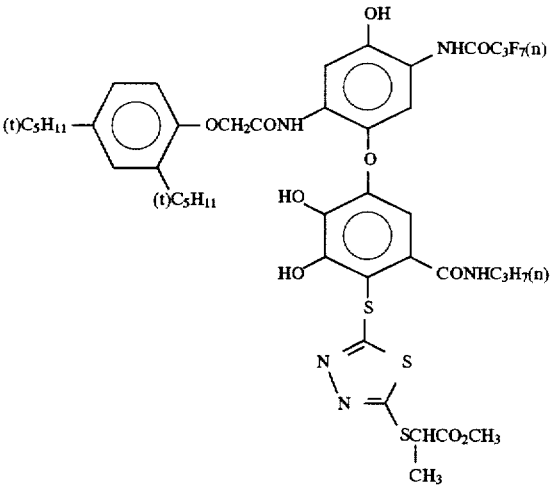

-continued

ExY-4

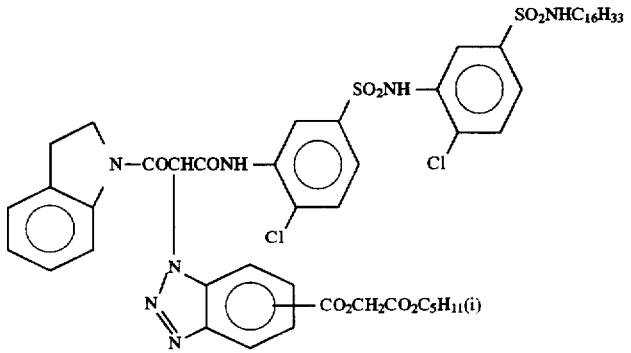

ExY-5

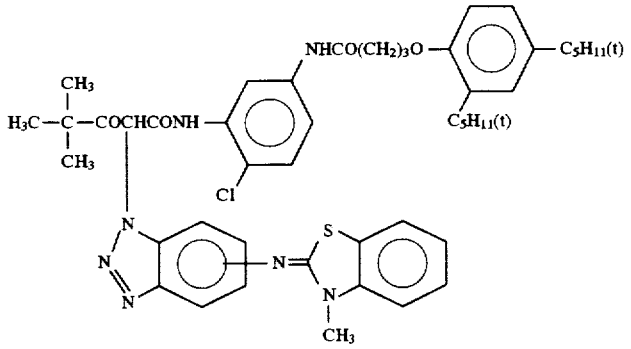

HBS-3

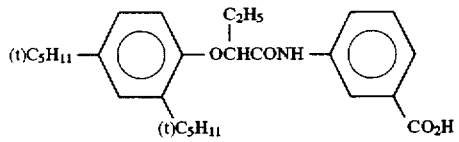

Eighth layer (Intermediate-sensitive green-sensitive emulsion layer)

| | |
|---|---|
| Silver iodobromide emulsion H | Silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |

Ninth layer (High-sensitive green-sensitive emulsion layer)

| | |
|---|---|
| Silver iodobromide emulsion I | Silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethylacrylate latex | 0.15 |
| Gelatin | 1.33 |

-continued
ExM-4
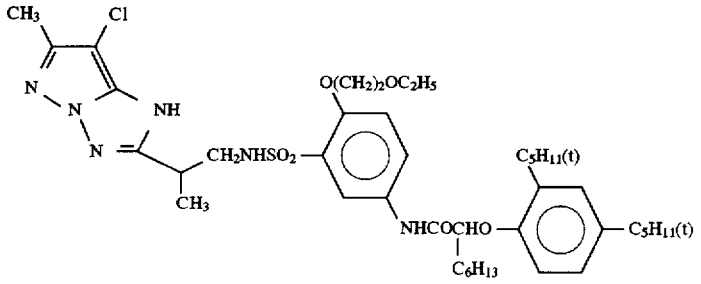
ExM-5
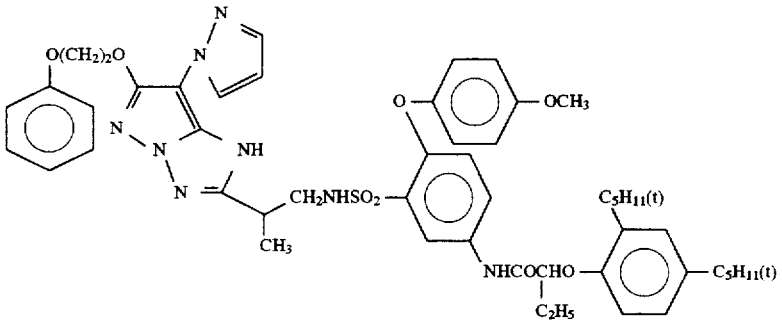
Cpd-3
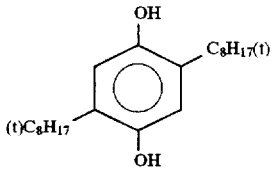
Tenth layer (Yellow filter layer)
| | |
|---|---|
| Yellow colloidal silver | Silver 0.015 |
| Cpd-1 | 0.16 |
| Solid dispersion dye ExF-5 | 0.060 |
| Solid dispersion dye ExF-6 | 0.060 |
| Oil-soluble dye ExF-7 | 0.010 |
| HBS-1 | 0.60 |
| Gelatin | 0.60 |
ExF-5
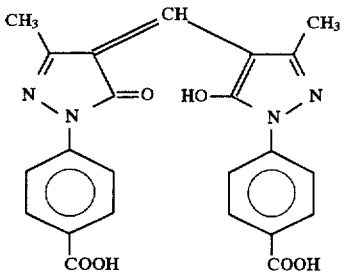

-continued
ExF-6
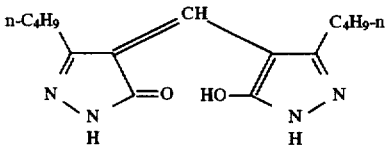
ExF-7
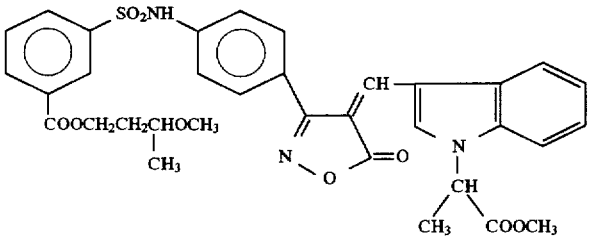
Eleventh layer (Low-sensitive blue-sensitive emulsion layer)
| | |
|---|---|
| Silver iodobromide emulsion J | Silver 0.09 |
| Silver iodobromide emulsion K | Silver 0.09 |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
ExS-7
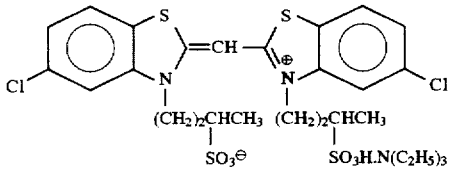
ExY-2
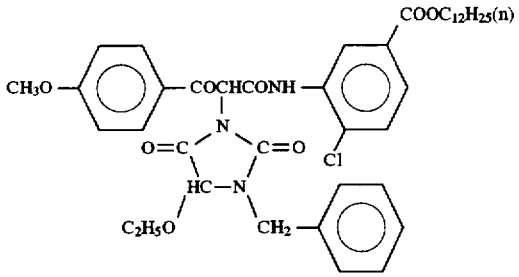
ExY-3
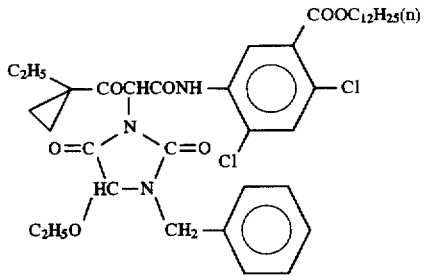

-continued

Twelfth layer (High-sensitive blue-sensitive emulsion layer)

| | |
|---|---|
| Silver iodobromide emulsion L | Silver 1.00 |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |

Thirteenth layer (First protective layer)

| | |
|---|---|
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |

UV-1

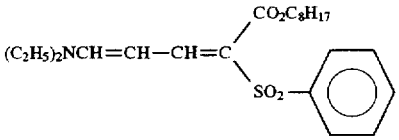

UV-2

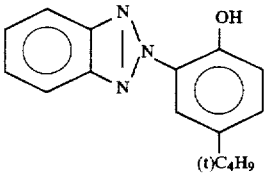

UV-3

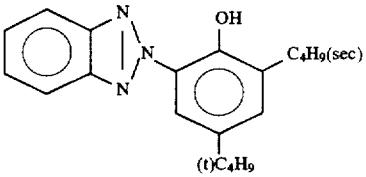

HBS-4 Tri(2-ethylhexyl)phosphate

Fourteenth layer (Second protective layer)

| | |
|---|---|
| Silver iodobromide emulsion M | Silver 0.10 |
| H-1 | 0.40 |
| B-1 (Diameter 1.7 μm) | $5.0 \times 10^{-2}$ |
| B-2 (Diameter 1.7 μm) | 0.15 |
| B-3 | 0.05 |
| S-1 | 0.20 |
| Gelatin | 0.70 |

H-1

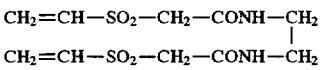

B-1

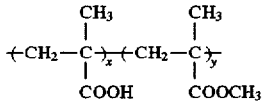

x/y = 10/90 (ratio by weight)
Average molecular weight: about 35,000

-continued

B-2

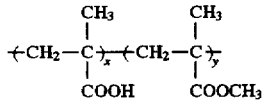

x/y = 40/60 (ratio by weight)
Average molecular weight: about 20,000

B-3

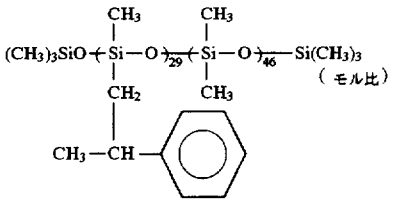

(molar ratio)
Average molecular weight: about 8,000

S-1

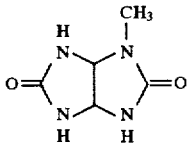

In order to improve shelf life, processing performance, pressure resistance, mildewproofing/antifungal properties, antistatic properties, and easiness of coating, respective layers are devised to contain W-1 to W-3, B-4 to B-6, F-1 to F-17, iron salts, lead salts, gold salts, platinum salts, palladium salts, iridium salts, and rhodium salts.

W-1

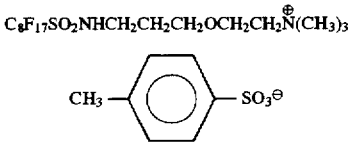

W-2

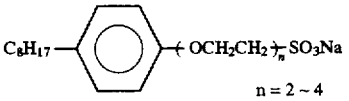

n = 2 ~ 4

W-3

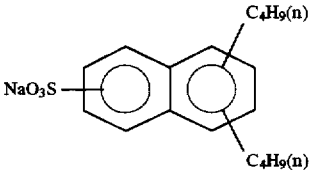

B-4

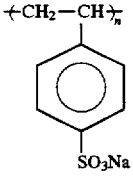

Average molecular weight: about 750,000

B-5

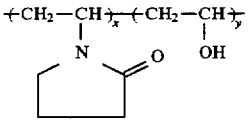

x/y=70/30 (ratio by weight)

Average molecular weight: about 17,000

B-6

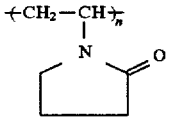

Average molecular weight: about 10,000

F-1

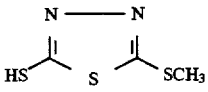

F-2

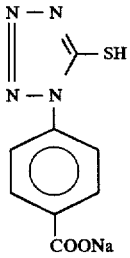

-continued

F-3

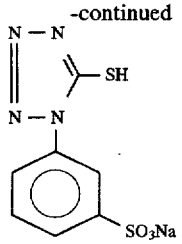

F-4

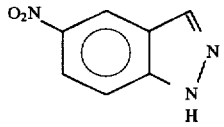

F-5

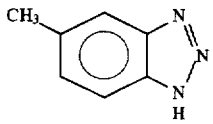

F-6

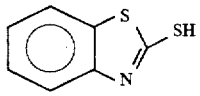

F-7

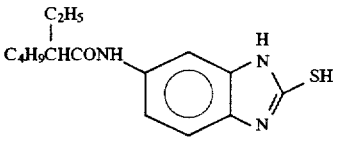

F-8

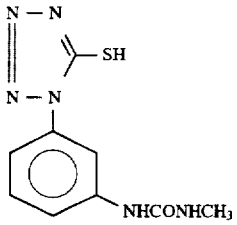

F-9

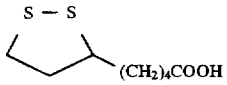

F-10

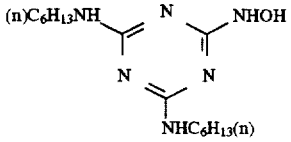

F-11

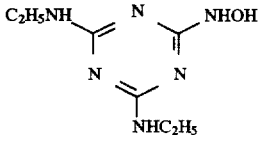

-continued

F-12

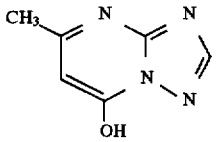

F-13

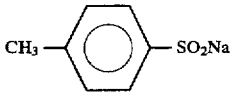

F-14

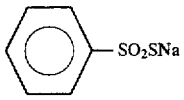

F-15

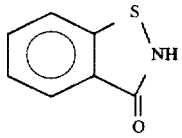

F-16

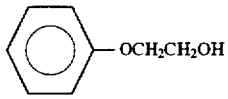

F-17

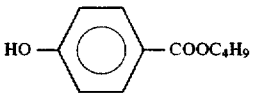

In Table 1 below, the following should be noted.

(1) Emulsions J to L have undergone reduction sensitization with thiourea dioxide and thiosulfonic acid in accordance with the examples described in Japanese Patent Application Laid-Open (JP-A) No. 2-191938.

(2) Emulsions A to I have undergone gold sensitization, sulfur sensitization, and selenium sensitization in the presence of spectral sensitizing dyes and sodium thiocyanate, in accordance with the examples described in Japanese Patent Application Laid-Open (JP-A) No. 3-237450.

(3) In preparing tabular grains, low-molecular weight gelatin was used in accordance with the examples described in Japanese Patent Application Laid-Open (JP-A) No. 1-158426.

(4) In tabular grains, dislocation lines as described in Japanese Patent Application Laid-Open (JP-A) No. 3-237450 were observed by use of a high-voltage electron microscope.

(5) Grains of emulsion L are double structured grains each having a high iodine core, as described in Japanese Patent Application Laid-Open (JP-A) No. 60-143331.

TABLE 1

| | Av. AgI content (%) | Variation coefficient (%) regarding intergrain AgI content | Average grain diameter Sphere-equivalent diameter (μm) | Variation coefficient (%) regarding grain diameter | diameter of projected are Circle-equivalent diameter (μm) | Diameter/ thickness ratio |
|---|---|---|---|---|---|---|
| Emulsion | | | | | | |
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

Preparation of a dispersion of organic solid dyes:

The aforementioned ExF-2 was formed into a dispersion according to the following method. Briefly, 21.7 ml of water, 3 ml of an aqueous 5% sodium p-octylphenoxyethoxyethoxy ethane sulfonate, and 0.5 g of an aqueous 5% p-octylphenoxy polyoxyethylene ether (polymerization degree: 10) were placed in a 700-ml pot mill. Into the mill were also added 5.0 g of the dye ExF-2 and 500 ml of zirconium oxide beads (diameter: 1 mm), and the contents were mixed for 2 hours to obtain a dispersion. This process was performed by use of a BO-type vibration ball mill manufactured by Chuo Koki K.K. After completion of dispersion, the contents of the mill were added to 8 g of an aqueous 12.5% gelatin solution. Beads were removed by filtration, to obtain a dye-in-gelatin dispersion. The mean size of the fine dye particles was 0.44 μm.

Similarly, solid dispersions of ExF-3, ExF-4, and ExF-6 were obtained. The mean sizes of the resultant fine dye particles were 0.24 μm, 0.45 μm, and 0.52 μm, respectively. ExF-5 was dispersed by a microprecipitation dispersing method described in Example 1 of EP-549,489-A. The mean particle size was 0.06 μm.

The photosensitive layers described in (4) above were formed on a support prepared as described above so as to create a photosensitive material (sample 101).

The sample 101 was cut into strips each measuring 24 mm in width by 160 cm in length. At the position 0.7 mm inside from one lengthwise edge of the strip, a plurality of pairs of square perforations each having a size of 2 mm×2 mm were made at intervals of 32 mm. The resultant strip was housed in a film cartridge made of plastics described in U.S. Pat. No. 5,296,887 (FIGS. 1 through 7).

The film specimen housed in the cartridge was pulled outside, and FM signals were recorded thereon, from the side on which a magnetic recording layer was provided, between the perforations at a speed of 100 mm/s through use of a magnetic recording device equipped with a head which was capable of inputting/outputting signals (head gap: 5 μm, turn number: 2,000).

After being recorded with FM signals, the film specimen was subjected to an entire-surface uniform exposure of 1,000 cms on its emulsion-layer surface, and thereafter the specimen was returned into the original film cartridge made of plastics.

The thus-finished sample 101, as being housed in the cartridge, was set in a cartridge magazine 503 as shown in FIG. 5.

(6) Preparation of embossed partitioning members

The material used was PEN film having a gelatin undercoat (hardened with formalin, thickness of the undercoat: 0.5 μm).

The material had a thickness of about 90 μm and a width of about 25 mm. Embossments were provided at positions 2 mm from both edges in the widthwise direction, and at intervals of 5 mm in the longitudinal direction.

The embossments were formed on the surface of the undercoat of the material through use of a machine as shown in FIG. 10 of Japanese Patent Application Laid-Open (JP-A) No. 5-210196 by the application of pressure and heat, so that each embossment had a cone shape with a height of 250 μm and the diameter at half the height was 400 μm.

One end of the thus-prepared embossed partitioning member was attached to the core member so that the member extended in a spiral shape from the core member to form a gap between one surface of the partitioning member and the other surface of the partitioning member at a distance of 360 μm in a processing container 502 shown in FIG. 5.

The photosensitive material pulled out of the cartridge was inserted in the processing container 502 shown in FIG. 5. In the processing container 502, the protrusions of the embossments of the partitioning member were set to face the emulsion layer of the photosensitive material. The spacing between the photosensitive material and the partitioning member was maintained to be about 250 μm. Subsequently, the photosensitive material was processed through use of the processing solutions and processing steps described below. In the color developing step, the processing solution was circulated in the container as follows: a liquid supply for 6 seconds (forward direction), a stoppage for 4 seconds, and a liquid supply for 6 seconds (adverse direction), and subsequently, a cycle of the mentioned liquid supply and stoppage was repeated so as to circulate the liquid at a flow rate of 25 ml/s. In the bleaching step and subsequent steps, respective processing solutions were circulated at a flow rate of 25 ml/s in a fixed direction. The photosensitive material that had been processed was rewound in the cartridge while being dried in a drying section 505 shown in FIG. 5. The sample 101 was subjected to the above-described sequential processing.

Throughout the processing, the photosensitive material was never detached from the cartridge.

The processor used in the present example was basically the same as that described in FIG. 5 but with a modification so as to permit use of 5 processing tanks 508. The process performed through use of this processor is referred to as processing step A.

For comparison, an automatic processing apparatus FP362B(AL) (Fuji Photo Film Co., Ltd.) was used. The comparative processing is referred to as processing step B. In processing steps A and B, the sample 101 was commonly processed with a processing solution having the same composition.

After the photosensitive material had been rehoused in an intermediate Cartridge which was designed to be exclusively processed with a detacher DT100 (Fuji Photo Film Co., Ltd.) and then affixed onto a reader, the photosensitive material was processed. After processing of the photosensitive material had been completed, the reader was detached and the material was housed in the original cartridge by use of a reattacher AT100 (Fuji Photo Film Co., Ltd.).

The processing steps and the compositions of respective processing solutions are shown below.

(Processing step A)

| Processing step | Process time | Temp. | Tank Capacity |
|---|---|---|---|
| Color development | 3 min. 5 sec. | 38.0° C. | 1.0 (L) |
| Bleaching | 50 sec. | 38.0° C. | 1.0 (L) |
| Fixing | 1 min. 40 sec. | 38.0° C. | 1.0 (L) |
| Washing | 30 sec. | 38.0° C. | 1.0 (L) |
| Stabilizing | 40 sec. | 38.0° C. | 1.0 (L) |
| Drying | 1 min. 30 sec. | 60° C. | — |

(Processing step B)

| Processing step | Process time | Temp. | Tank Capacity |
|---|---|---|---|
| Color development | 3 min. 5 sec. | 38.0° C. | 11.5 (L) |
| Bleaching | 50 sec. | 38.0° C. | 4.0 (L) |
| Fixing (1) | 50 sec. | 38.0° C. | 4.0 (L) |
| Fixing (2) | 50 sec. | 38.0° C. | 4.0 (L) |
| Washing | 30 sec. | 38.0° C. | 3.0 (L) |
| Stabilizing (1) | 20 sec. | 38.0° C. | 3.0 (L) |
| Stabilizing (2) | 40 sec. | 38.0° C. | 3.0 (L) |
| Drying | 1 min. 30 sec. | 60° C. | — |

The stabilizing solution was supplied from (2) to (1) (counterflow). The entirety of the overflow of washing water was introduced into the fixing step (2). The fixing solution tank was also connected from (2) to (1) so as to The compositions of the respective processing solutions were as follows.

| | Tank sol. (g) |
|---|---|
| (Color developing solution) | |
| Diethylenetriaminepentaacetic acid | 2.0 |
| 1-Hydroxyethylidene-1,1-diphosphonic acid | 2.0 |
| Sodium sulfite | 3.9 |
| Potassium carbonate | 37.5 |
| Potassium bromide | 1.4 |
| Potassium iodide | 1.3 mg |
| Disodium-N,N-bis(sulfonatoethyl)-hydroxylamine | 2.0 |
| Hydroxylamine sulfate | 2.4 |
| 2-Methyl-4-[N-ethyl-N-(β-hydroxyethyl)-amino]aniline sulfate | 4.5 |
| Total amount after adding water | 1.0 liter |

-continued

| | Tank sol. (g) |
|---|---|
| pH (adjusted with KOH and $H_2SO_4$) | 10.05 |
| (Bleaching solution) | |
| 1,3-Diaminopropane tetraacetic acid ferric ammonium.$H_2O$ | 138 |
| Ammonium bromide | 80 |
| Ammonium nitrate | 16 |
| Succinic acid | 40 |
| Maleic acid | 33 |
| Total amount after adding water | 1.0 liter |
| pH (adjusted with ammonia water) | 4.6 |
| (Fixing solution) | |
| Ammoniuim methanesulfinate | 10 |
| Ammoniium methanethiosulfonate | 4 |
| Aqueous solution of ammonium thiosulfate (700 g/liter) | 280 ml |
| Imidozole | 7 |
| Ethylenediaminetetraacetic acid | 15 |
| Total amount after adding water | 1.0 liter |
| pH (Adjusted with ammonia water and acetic acid) | 7.4 |

(Washing water)

Tap water was passed through a mixed-bed-type column packed with H-type strongly acidic cationic exchange resin (Amberlight IR-120B, product of Rohm and Haas) and an OH-type strongly basic anionic exchange resin (Amberlight IR-400, product of Rohm and Haas) to thereby reduce the concentrations of calcium ions and magnesium ions to not more than 3 mg/liter. Thereafter, sodium isocyanuric dichloride (20 mg/liter) and sodium sulfate (150 mg/liter) were added. The pH of the resultant solution was in the range of 6.5–7.5.

| (Stabilizing solution) | Tank sol. (g) |
|---|---|
| Sodium p-toluenesulfinate | 0.03 |
| Polyoxyethylene-p-monononylphenylether (Average polymerization degree: 10) | 0.2 |
| Disodium ethylenediaminetetraacetate | 0.05 |
| 1,2,4-Triazole | 1.3 |
| 1,4-Bis(1,2,4-triazole-1-ylmethyl) piperadine | 0.75 |
| 1,2-Benzoisothiazolin-3-one | 0.10 |
| Total amount after adding water | 1.0 liter |
| pH | 8.5 |

Next, the film that had been housed in the cartridge was pulled out, and signals were read out at the same speed at which the signal had been recorded with the head of the magnetic recording device, to thereby check whether the signals were output correctly. The proportion of the count of error bits to that of input bits (error ratio) was not more than 0.005% for any of the specimens tested. An error ratio of not less than 0.1% results in an evaluation of NG, and the error ratio should be not more than 0.05%, preferably not more than 0.01%, and more preferably not more than 0.008%. Thus, lower error ratios eliminate problems in practical use. The magnetic information is useful in cameras that have a function of recording parameters of camera exposure conditions. It enables, for example, confirmation of a desirable print format such as a regular format or a panorama format, or suitable printing conditions before the printing on color papers, leading to improvement of the quality of prints.

In both processing steps A and B, the signals recorded on the magnetic recording layer were able to be processed without being damaged. Processing step B required about 20 minutes before a single strip of film was developed and fed into a printer, whereas processing step A required about 9 minutes for the same operation.

Moreover, in processing step A, it is possible to exploit a system that improves quality by way of magnetic recording, with intricate operations such as charging into an intermediate cartridge by use of a "detacher" and an "attacher" being eliminated. Thus, according to the above-described embodiment of the present invention, it was possible to improve the operation efficiency and to reduce the work load.

Example 2

The sample 101 described in Example 1 of the present invention was used in photographing with a camera, and was processed by use of a processing apparatus similar to that described in Example 1 as well as the processing solutions and processing steps described below. In the color developing step and the subsequent steps, respective processing solutions were circulated at a flow rate of 25 ml/s in a fixed direction such that the solutions flowed in the transverse direction of the photosensitive material from the side on which perforations were not provided to the opposite side. The two drying methods and the two stirring methods as described below were adopted.

Drying method A refers to the case in which the specimen is dried at the drying section 505 in FIG. 5. Drying method B refers to the case in which the specimen is dried by hot air of blower 506 by modifying the process such that the hot air passes through the processing container 502. Stirring method "a" refers to the case in which circulation is performed in a fixed direction such that the solutions flow in the transverse direction of the photosensitive material from the side on which perforations were not provided toward the opposite side. Stirring method "b" refers to the case in which circulation is performed in a fixed direction such that the solutions flow in the transverse direction of the photosensitive material from the side on which perfomations were provided toward the opposite side.

The processor used in the present example was basically the same as that described in FIG. 5, but with a modification so as to permit use of 4 processing solution tanks 508. Processing containers were changed whenever processing conditions were changed. One hundred strips of the sample 101 were processed for each processing condition. The processing was performed up to 2 strips per day (for each condition). Thus, the test took about 2 months before being completed and subjected to the below-described evaluation.

The processing steps and the compositions of respective processing solutions are shown below.

(Processing steps)

| Step | Processing time | Temperature |
|---|---|---|
| Color development | 60 sec. | 45.0° C. |
| Bleaching/fixing | 60 sec. | 45.0° C. |
| Washing | 15 sec. | 45.0° C. |
| Stabilizing | 15 sec. | 45.0° C. |
| Drying | 30 sec. | 80° C. |

The compositions of the respective processing solutions were as follows.

| | Mother liquid (g) |
|---|---|
| (Color developing solution) | |
| Diethylenetriaminepentaacetic acid | 4.0 |
| 1-Hydroxyethylidene-1,1-diphosphonic acid | 3.0 |

-continued

| | Mother liquid (g) |
|---|---|
| Sodium sulfite | 4.0 |
| Potassium carbonate | 40.0 |
| Potassium bromide | 2.0 |
| Potassium iodide | 1.3 mg |
| Hydroxylamine sulfate | 2.0 |
| Disodium-N,N-bis(sulfonatoethyl)-hydroxylamine | 2.4 |
| 2-Methyl-4-[N-ethyl-N-(β-hydroxyethyl)-amino]aniline sulfate | 11.0 |
| Total amount after adding water | 1.0 liter |
| pH (adjusted with KOH and $H_2SO_4$) | 10.05 |
| (Bleaching/fixing solution) | |
| Ethylenediaminetetraacetic acid ferric ammonium.$2H_2O$ | 40.0 |
| 2{[1-(Carboxyethyl)carboxymethylamino]ethyl}carboxymethylamino benzoic acid ferric ammonium.$H_2O$ | 30.0 |
| Ethylenediaminetetraacetic acid | 6.0 |
| Succinic acid | 12.0 |
| Ammonium sulfite | 20 |
| Aqueous solution of ammonium thiosulfate (700 g/liter) | 300 ml |
| p-Aminobenzene sulfinic acid | 5.0 |
| Ammonium iodide | 1.0 |
| Total amount after adding water | 1.0 liter |
| pH (adjusted with ammonia water and nitric acid) | 6.0 |

(Washing water)

Tap water was passed through a mixed-bed-type column packed with H-type strongly acidic cationic exchange resin (Amberlight IR-120B, product of Rohm and Haas) and an OH-type strongly basic anionic exchange resin (Amberlight IR-400, product of Rohm and Haas) to thereby reduce the concentrations of calcium ions and magnesium ions to not more than 3 mg/liter. Thereafter, sodium isocyanuric dichloride (20 mg/liter) and sodium sulfate (150 mg/liter) were added. The pH of the resultant solution was in the range of 6.5–7.5.

| (Stabilizing solution) | Mother liquid (g) |
|---|---|
| Succinic acid | 0.6 |
| Sodium p-toluenesulfinate | 0.03 |
| Polyoxyethylene-p-monononylphenylether (Average polymerization degree: 10) | 0.2 |
| 1,2-Benzoisothiazolin-3-one | 0.05 |
| Sodium chlorinated isocyanurate | 0.02 |
| Total amount after adding water | 1.0 liter |
| pH (adjusted with ammonia water and nitric acid) | 5.0 |

After completion of processing, two types of evaluation were performed as described below.

Smudge accumulated during processing: In each test group, the processing container which had been used for about 2 months was visually observed.

Unevenness of processed film: In each test group, one hundred samples (40 exposures per sample) that had undergone processing were visually observed to thereby evaluate the frequency of occurrence of unevenness of the processed samples. Uneven portions that did not affect image portions were also counted. When two uneven portions were found in a single frame, they were counted as two occurrences.

Frequency of occurrence of uneven portions={(Number of uneven portions)/4,000}×100 (%)

The results are shown in Table 2.

TABLE 2

| Test No. | Sample No. | Drying method* | Stirring method** | Unevenness (%) | Smudge assess. | Remarks |
|---|---|---|---|---|---|---|
| 1 | 101 | A | a | 0.00 | I | Invention |
| 2 | 101 | A | b | 1.05 | I | Invention |
| 3 | 101 | B | a | 0.15 | II | Invention |
| 4 | 101 | B | b | 1.30 | II | Invention |

*A: Drying was performed in the drying section shown in FIG. 5.
B: Drying was performed in the processing container shown in FIG. 5.
**a: Circulation and stirring were performed in the direction in which the side without perforations was upstream.
b: Circulation and stirring was performed in the direction in which the side with perforations was upstream.
(Assessment of smudge deposited on processing containers)
I: No smudge such as precipitates. No need for maintenance
II: Slight amount of smudge such as precipitates. However, stain on photosensitive materials is at the level of practically no problem if maintenance is performed regularly
III: Small amount of smudge such as precipitates. Burden is imposed on routine maintenance. Stain on photosensitive materials is at the problematic level in practice.

The above test was performed only on embodiments of the present invention. There existed combinations of a drying method and a circulation of processing solution that did not provide completely satisfactory results if continuous and rapid processing was attempted. However, when the drying method and the circulation of processing solution were selected to realize a preferred embodiment of the present invention (in the present example, the combination of A-a is the best), satisfactory results of preventing smudge from being deposited during processing and of suppressing unevenness of processed films were obtained.

Example 3

(1) Material, etc. of the support

The support used in the present invention was prepared as follows.

PEN: Polyethylene-2,6-naphthalate polymer (100 parts by weight) was compounded with Tinuvin P.326 (Ciba-Geigy; a UV absorber, 2 parts by weight) and bought to dryness. The compound was melted at 300° C. and extruded through a T-shaped die. The extruded material was subjected to longitudinal stretching (×3.3) at 140° C. and subsequently to transversal stretching (×3.3) at 130° C. The resultant stretched film was thermally set at 250° C. for 6 seconds to thereby obtain a PEN film having a thickness of 90 μm. The PEN film contained suitable amounts of blue dyes, magenta dyes, and yellow dyes (I-1, I-4, I-6, I-24, I-26, I-27, II-5 described in Technical Disclosure Bulletin No. 94-6023). The film was wound on a stainless steel rod having a diameter of 20 cm, and a thermal hysteresis was applied at 110° C. for 48 hours so as to obtain a support which is resistant to curling.

TAC: Triacetylcellulose was prepared by customary solution casting through use of a 15 wt. % band method: methylene chloride/methanol=82/8 (by weight), TAC concentration 13%, TPP/BDP=2/1 (plasticizers; TPP stands for triphenylphosphate, BDP stands for biphenyldiphenylphosphate).

Undercoating, forming of a backing layer, and preparation of photosensitive layers were performed as described in Example 1 (see (2), (3), and (4) of Example 1).

Onto each of the thus-prepared two different supports, photosensitive layers indicated by (4) were applied, to thereby form photosensitive materials. The sample including a PEN support is referred to as sample 301, and the sample including a TAC support is referred to as sample 302. Also, a sample 303 was prepared which contained a PEN support as described above and which had not undergone a heat treatment of 110° C. for 48 hours.

The samples 301 through 303 were used in photographing, and subsequently, the samples were processed in a manner similar to that described in Example 1 through use of the below-described processing steps and processing solutions (2 strips of samples per day, each strip containing 40 frames). The test was performed for about 4 months. The preservative contained in the color developing solution was changed as shown in Table 3. The samples were simultaneously and continuously processed in six processing apparatuses using respective processing solutions listed in Table 3.

The processing steps and the compositions of respective processing solutions are shown below.

(Processing steps)

| Step | Processing time | Temperature |
|---|---|---|
| Color development | 60 sec. | 40.0° C. |
| Bleaching/fixing | 60 sec. | 40.0° C. |
| Washing | 20 sec. | 40.0° C. |
| Drying | 40 sec. | 70° C. |

The compositions of the respective processing solutions were as follows.

| | Mother liquid (g) |
|---|---|
| (Color developing solution) | |
| Diethylenetriaminepentaacetic acid | 4.0 |
| 1-Hydroxyethylidene-1,1-diphosphonic acid | 3.0 |
| Sodium sulfite | 4.0 |
| Potassium carbonate | 40.0 |
| Potassium bromide | 1.0 |
| Potassium iodide | 1.3 mg |
| Preservative as described in Table 3 | 0.06 mol |
| 2-Methyl-4-[N-ethyl-N-(β-hydroxyethyl)-amino]aniline sulfate | 9.0 |
| Total amount after adding water | 1.0 liter |
| pH (adjusted with KOH and $H_2SO_4$) | 10.05 |
| (Bleaching/fixing solution) | |
| Ethylenediaminetetraacetic acid ferric ammonium.$2H_2O$ | 30.0 |
| 3(Carboxymethyl{2-[carboxymethyl(1-carboxxymethylpropylamino]ethyl}amino)-pentanoic acid ferric ammonium.$3H_2O$ | 50.0 |
| Ethylenediaminetetraacetic acid | 6.0 |
| Succinic acid | 12.0 |
| Aqueous solution of ammonium thiosulfate (700 g/liter) | 270 ml |
| p-Aminobenzene sulfinic acid | 5.0 |
| Ammonium iodide | 1.0 |
| Total amount after adding water | 1.0 liter |
| pH (adjusted with ammonia water and nitric acid) | 6.0 |

(Washing water)

Same as that used in Example 2

After completion of continuous processing, the samples 301 through 303 were assessed in terms of the error ratio as described in Example 1 and also assessed in terms of deposition of smudge as described in Example 2.

The results are shown in Table 3.

TABLE 3

| Test No. | Sample No. | Preservative | Error ratio (%) | Smudge assess. |
|---|---|---|---|---|
| 1 | 301 | Hydroxylamine sulfate | 0.0046 | II |
| 2 | 302 | Hydroxylamine sulfate | 0.0089 | II |
| 3 | 303 | Hydroxylamine sulfate | 0.0090 | III |
| 4 | 301 | Disodium-N,N-bis(sulfonatoethyl)hydroxylamine | 0.0037 | I |
| 5 | 302 | Disodium-N,N-bis(sulfonatoethyl)hydroxylamine | 0.0083 | II |
| 6 | 303 | Disodium-N,N-bis(sulfonatoethyl)hydroxylamine | 0.0082 | II |

(Assessment of smudge)
I: No smudge such as precipitates. No need for maintenance
II: Slight amount of smudge such as precipitates. Practically not problematic if maintenance is performed regularly.
III: Small amount of smudge such as precipitates. Burden is imposed on routine maintenance.
IV: Considerable amount of smudge such as precipitates. Burden is impoised on routine maintenance, and the smudge level is problematic in practice.

The above test was performed only on embodiments of the present invention. However, when the PEN support that had undergone heat treatment and/or the color developing solution that did not contain hydroxylamine, it was possible to reduce errors in reading-out of magnetically recorded information and to prevent deposition of smudge in long-term continous rapid processing.

Example 4

A specimen 101 as described in Example 1 was used, and FM signals were recorded thereon, from the side on which a magnetic recording layer was provided, between the perforations at a speed of 100 mm/s through use of a magnetic recording device equipped with a head which was capable of inputting/outputting signals (head gap: 5 μm, turn: 2,000).

After being recorded with FM signals, the film specimen was subjected to an entire-surface uniform exposure of 1,000 cms on its emulsion-layer surface, and thereafter the specimen was returned into the original film cartridge made of plastics.

The thus-finished sample 101, as being housed in the cartridge, was set in a cartridge magazine 604 as shown in FIG. 6.

A processor shown in FIG. 6 was used, and the processing solutions and the processing steps were identical to those described for Test No. 4 in Example 3. In the color developing step, the processing solution was circulated as follows: a liquid supply for 6 seconds (forward direction), a stoppage for 4 seconds, and a liquid supply for 6 seconds (adverse direction), and subsequently, a cycle of the mentioned liquid supply and stoppage was repeated so as to circulate the liquid at a flow rate of 60 ml/s. In the bleaching step and subsequent steps, respective processing solutions were circulated at a flow rate of 60 ml/s in a fixed direction along the long side of the photosensitive material. The photosensitive material that had been processed was rewound in the cartridge while being dried in a drying section 605 shown in FIG. 6. The above-described sequential processing was performed while changing the distance between the photosensitive material outlet port of housing container 603 and the photosensitive material inlet port of processing container 602. For each distance listed in Table 4, twenty sample strips were continuously processed.

After completion of continuous processing, the samples were assessed in terms of the error ratio as described in Example 1 and deposition of smudge as described in Example 2.

Unevenness of processed film: In each test group, twenty samples (40 pictures per sample) that had undergone processing were visually observed to thereby evaluate the frequency of occurrence of unevenness of the processed samples. Uneven portions that did not affect image portions were also counted. When two uneven portions were found in a single frame, they were counted as two occurrences.

Frequency of occurrence of uneven portions={(Number of uneven portions)/800}×100 (%)

The results are shown in Table 4.

TABLE 4

| Test No. | Sample No. | Distance* | Error ratio (%) | Unevenness (%) |
|---|---|---|---|---|
| 1 | 101 | 5.0 cm | 0.0019 | 0.000 |
| 2 | 101 | 8.0 cm | 0.0031 | 0.125 |
| 3 | 101 | 10.0 cm | 0.0045 | 0.250 |
| 4 | 101 | 15.0 cm | 0.0094 | 0.625 |

*Distance between the sample outlet port of housing container 603 and the sample inlet port of processing container 602.

All the above-described examples represent embodiments of the present invention. When the distance between the photosensitive material outlet port of the housing container and the photosensitive material inlet port of the processing container are suitably selected, it was possible to reduce errors in reading-out of magnetically recorded information and to prevent deposition of smudge in long-term continuous rapid processing.

As described above, according to the present invention, there was provided a processing system in which quality was improved through use of magnetic information, intricate operations were eliminated, the processing apparatus was made compact, the processing method was simple, and rapid processing was possible.

What is claimed is:

1. A method for processing a silver halide photosensitive material for photographing, comprising the steps of: pulling out the photosensitive material from a housing container and introducing the photosensitive material into a processing container; introducing a processing solution into the processing container for processing a silver halide photosensitive material for photographing, which has a support and at least one photosensitive silver halide emulsion layer and a magnetic recording layer containing magnetic particles on the support, without separating the photosensitive material from the housing container for photographic, wherein the solution is introduced into a gap formed between the photosensitive surface of the photosensitive material and the reverse surface of the photosensitive material, or between the photosensitive surface of the photosensitive material and a member; replacing, before a single step of processing is completed, the processing solution in a volume equivalent to or greater than a volume of the space of the gap through use of a supply mechanism for supplying the replacing solution, the gap being substantially fixedly retained, to thereby subject the photosensitive material to color development, desilvering, and washing and/or stabilization; and returning the processed photosensitive material back into the housing container.

2. A method for processing a silver halide photosensitive material for photographing according to claim 1, wherein a drying section is provided between the housing container and the processing container so that the processed photosensitive material is returned into the housing container after or while being dried by the drying section.

3. A method for processing a silver halide photosensitive material for photographing according to claim 1, wherein the photosensitive material has perforations along only one of its side edges, and the processing solution is introduced from an unperforated side across its width.

4. A method for processing a silver halide photosensitive material for photographing according to claim 2, wherein the photosensitive material has perforations along only one of its side edges, and the processing solution is introduced from an unperforated side across its width.

5. A method for processing a silver halide photosensitive material for photographing according to claim 1, wherein the support of the photosensitive material has a thickness of 50 to 150 μm and is of polyethylene-aromatic-dicarboxylate type polyester having a glass transition point of 50° to 200° C., and the support is thermally treated at a temperature of not less than 40° C. and not more than the glass transition point for 0.1 to 1500 hours, before an undercoat layer is formed thereon or during the time between formation of the undercoat layer and formation of an emulsion layer.

6. A method for processing a silver halide photosensitive material for photographing according to claim 2, wherein the support of the photosensitive material has a thickness of 50 to 150 μm and is of polyethylene-aromatic-dicarboxylate type polyester having a glass transition point of 50° to 200° C., and the support is thermally treated at a temperature of not less than 40° C. and not more than the glass transition point for 0.1 to 1500 hours, before an undercoat layer is formed thereon or during the time between formation of the undercoat layer and formation of an emulsion layer.

7. A method for processing a silver halide photosensitive material for photographing according to claim 3, wherein the support of the photosensitive material has a thickness of 50 to 150 μm and is of polyethylene-aromatic-dicarboxylate type polyester having a glass transition point of 50° to 200° C., and the support is thermally treated at a temperature of not less than 40° C. and not more than the glass transition point for 0.1 to 1500 hours, before an undercoat layer is formed thereon or during the time between formation of the undercoat layer and formation of an emulsion layer.

8. A method for processing a silver halide photosensitive material for photographing according to claim 4, wherein the support of the photosensitive material has a thickness of 50 to 150 μm and is of polyethylene-aromatic-dicarboxylate type polyester having a glass transition point of 50° to 200° C., and the support is thermally treated at a temperature of not less than 40° C. and not more than the glass transition point for 0.1 to 1500 hours, before an undercoat layer is formed thereon or during the time between formation of the undercoat layer and formation of an emulsion layer.

9. A method for processing a silver halide photosensitive material for photographing according to claim 1, wherein the color developing solution does not substantially contain hydroxylamine.

10. A method for processing a silver halide photosensitive material for photographing according to claim 2, wherein the color developing solution does not substantially contain hydroxylamine.

11. A method for processing a silver halide photosensitive material for photographing according to claim 3, wherein the color developing solution does not substantially contain hydroxylamine.

12. A method for processing a silver halide photosensitive material for photographing according to claim 4, wherein the color developing solution does not substantially contain hydroxylamine.

13. A method for processing a silver halide photosensitive material for photographing according to claim 5, wherein the color developing solution does not substantially contain hydroxylamine.

14. A method for processing a silver halide photosensitive material for photographing according to claim 6, wherein the color developing solution does not substantially contain hydroxylamine.

15. A method for processing a silver halide photosensitive material for photographing according to claim 7, wherein the color developing solution does not substantially contain hydroxylamine.

16. A method for processing a silver halide photosensitive material for photographing according to claim 8, wherein the color developing solution does not substantially contain hydroxylamine.

* * * * *